US009885230B2

(12) United States Patent
Leroux

(10) Patent No.: US 9,885,230 B2
(45) Date of Patent: Feb. 6, 2018

(54) PAD DRILLING METHOD FOR DRILLING MULTIPLE WELLS AND A MULTI-WELL PAD SYSTEM EMPLOYING THE SAME

(71) Applicant: Tundra Process Solutions Ltd., Calgary (CA)

(72) Inventor: Ashley Leroux, Calgary (CA)

(73) Assignee: Integrated Thermal Solutions Ltd., Calgary (CA)

( * ) Notice: Subject to any disclaimer, the term of this patent is extended or adjusted under 35 U.S.C. 154(b) by 259 days.

(21) Appl. No.: 14/873,132

(22) Filed: Oct. 1, 2015

(65) Prior Publication Data

US 2016/0312596 A1 Oct. 27, 2016

Related U.S. Application Data

(60) Provisional application No. 62/152,616, filed on Apr. 24, 2015.

(51) Int. Cl.

| | |
|---|---|
| ***E21B 41/00*** | (2006.01) |
| ***E21B 43/30*** | (2006.01) |
| ***E21B 7/00*** | (2006.01) |
| ***E21B 7/02*** | (2006.01) |

(52) U.S. Cl.
CPC ..... *E21B 43/30* (2013.01); *E21B 7/02* (2013.01)

(58) Field of Classification Search
CPC ..... E21B 43/30
See application file for complete search history.

(56) References Cited

U.S. PATENT DOCUMENTS

| | | | | |
|---|---|---|---|---|
| 5,014,784 | A * | 5/1991 | Shen | E21B 43/30 166/245 |
| 2011/0030963 | A1 | 2/2011 | Demong | |
| 2015/0176382 | A1* | 6/2015 | Chakrabarty | E21B 43/24 166/252.5 |
| 2015/0339411 | A1* | 11/2015 | Raphael | E21B 43/30 703/1 |

OTHER PUBLICATIONS

Cenvous FCCL Ltd.; Foster Creek Thermal Project Phase J Expansion; vol. 1, Section 5; Feb. 2013; 33 pages; Alberta, Canada.
Silverwell Energy; Audet SAGD Project; vol. 1, Section 5: Facilities and Process Design; Dec. 2013; 88 pages; Alberta, Canada.
(Continued)

*Primary Examiner* — David J Bagnell
*Assistant Examiner* — Dany E Akakpo
(74) *Attorney, Agent, or Firm* — Parlee McLaws LLP (CGY); Sean Goodwin

(57) ABSTRACT

A well pad having a plurality of wells is described. The well pad has two parallel rows or linear arrays of well pairs, mirrored to each other in both a W-E direction and a S-N direction orthogonal to the W-E direction. Each row of well pairs comprises an inner row of injection wells and an outer row of production wells. A plurality of wellhead connection modules and a piping module are deployed between the two rows of well pairs. Each wellhead connection module is connected to one, two three or four well pairs. The piping module connects the wellhead connection modules to a central processing facility.

20 Claims, 37 Drawing Sheets

(56) References Cited

OTHER PUBLICATIONS

The American Oil & Gas Reporter; Pad Design Key for Marcellus Drilling; Apr. 2011; 5 pages; Kanas, United States.
Csur; Understanding Well Construction and Surface Equipment; at least as early as Aug. 2015; 17 pages; Alberta, Canada.
First office action for Canadian counterpart Appl. 2,905,891, dated May 10, 2017; 4 pages.

* cited by examiner

12X12X8X6 Well Spacing with Future Redrill Planning

INJECTION WELLHEAD 112
PRODUCTION WELLHEAD 114
NO EXISTING WELL (FUTURE REDRILL)
WELLHEAD CONNECTION MODULE 120
PIPING MODULE 118
EXPANSION LOOP

12X12X8 GRID
DUAL ROWS, 20 WELL PAIRS
50m DOWN SPACING
250m TVD. VERTICAL DRILL

| | Well Spacing (m) | Wellpad Length (m) | Wellpad Width (m) | Total Wellpad Area ($m^2$) | | | |
|---|---|---|---|---|---|---|---|
| Tundra Projects 8WP + 8WW (SRHF - ESP) | 10 | 175 | 104 | 18200 | 10X10X8X5 Well Spacing | | |
| Tundra Projects 9WP + 9WW (SRHF - ESP) | 10 | 185 | 104 | 19240 | 10X10X8X5 Well Spacing | | |
| Tundra Projects 8WP (DRLF - ESP) | 12 | 148 | 108 | 15984 | 12X12X8X4 Well Spacing | | |
| Tundra Projects 8WP (DRHF - GL) | 16 | 164 | 112 | 18368 | 16X16X8X6 Well Spacing | | |
| Tundra Projects 8WP (DRLF - ESP) | 12 | 136 | 108 | 14688 | 12X12X8X4 Well Spacing | | |
| Tundra Projects 20WP (DRHF - ESP) | 16 | 260 | 112 | 29120 | 16X16X8X6 Well Spacing | | |
| | | | | | Reductions | | |
| | | | | | Footprint | Earthworks | Structural/Mechanical/Electrical |
| Client B 6WP (ESP) | 10 | | | | | | |
| Client C 8WP + 8 WW (Gas Lift) | 11 | 265<br>225 | 105<br>60 | 41325 | 56% | 56% | 66% |
| Client D - Gas Lift Option 8WP (Gas Lift) | 10 | 220 | 140 | 30800 | 40% | 40% | 45% |
| Client D - ESP/SSI Option 8WP (ESP) | 10 | 220 | 140 | 30800 | 48% | 48% | 56% |
| Client F 8WP + 8 WW (ESP) | 10 | 195 | 185 | 36075 | 50% | 50% | 25% |
| Client G 20WP (ESP) | 10 | 315 | 125 | 39375 | 26% | 26% | 17% |
| Client Z 9WP + 9WW (ESP) | 10 | 195 | 180 | 35350 | 34% | 34% | 5% |

FIG. 22

12X12X8X6 Well Spacing with Future Redrill Planning

PAD DRILLING METHOD FOR DRILLING MULTIPLE WELLS AND A MULTI-WELL PAD SYSTEM EMPLOYING THE SAME

FIELD OF THE DISCLOSURE

The present invention relates generally to a well pad system, and in particular to a pad drilling method for drilling multiple wells from a well pad with reduced and compact well spacing, and a multi-well pad system employing the same.

BACKGROUND

Multi-well pad drilling has become more and more popular in recent years. Multi-well pad drilling is a method and system for drilling multiple wellbores from a single well pad. As those skilled in the art understand, a well pad is a surface area having one or more wells or well pairs, as well as related equipment thereon. In traditional drilling, only one well is drilled at one site, and the drilling rig has to be disassembled after drilling a well, moved to the next site, and re-assembled therein to drill another well. Compared to the traditional drilling method, well pad drilling accommodates the drilling of multiple wells from one well pad. After drilling a well, the drill rig only needs to move a short distance to the next drilling location in the same well pad to drill the next well, avoiding the need of disassembling, moving and re-assembling drilling rigs between drilling two wells. Compared to traditional well drilling methods, multi-well pad drilling has the advantages of lower drilling cost, shorter completion time for drilling and completing a plurality of wells, and a smaller environmental footprint.

FIGS. 1A to 1G illustrate a conventional well pad system 10, wherein each well pad only comprises one row of production wells and one row of injection wells, straddling a piping and utility corridor. As shown in FIG. 1A, the pad system 10 comprises a Central Processing Facility (CPF) 12 coupled to one or more well pads 14 via pipelines 16. As known in the art, a well pad is a surface area having one or more wells, wellheads and associated processing and transmission equipment. Each of the multiple well pads requires connections to the CPF including communications (such as fibre optics), power, pipelines and access roads.

As shown in FIGS. 1B to 1D, the well pad 14 comprises a plurality of wellhead connection modules 20 coupled to a utility and piping module 22. Each wellhead connection module 20 comprises necessary components 30 such as pipelines, conduits, valves and the like, and is connected to the wellheads of a well pair. Each well pair comprises an injection well 24 for injecting steam or water downhole, and a production well 26 for producing thermally mobilized oil, via suitable natural or artificial lift means. Injection wells 24 may also be used for injecting air such as Nitrogen ($N_2$), water, or gas such as fuel gas or produced gas. Production wells 26 may also be used for producing emulsion, water, gas such as produced gas, or the like.

The piping module 22 also comprises necessary pipelines, conduits, valves, communications, power and other utilities, and couples the wellhead connection modules 20 to the CPF 12. The well pad 10 may also comprise one or more on-site processing facilities 28.

As shown in FIGS. 1E to 1G, in prior-art well pads 14, each pair of injection well 24 and production well 26 form a well pair, with a distance between the injection and production wells 24 and 26 normally about 20 meters (m) to 35 m. Well pairs are spaced laterally by about 10 m. The piping module 22, between the row of injection wells 24 and the row of production wells 26, normally has a width of about 5 m to 7.4 m. The 20 m×10 m spacing has been utilized to date as a typical minimum spacing to facilitate drilling access and accommodation of the infrastructure for each of a plurality of well pairs. Each well pad has been designed with its own infrastructure to manage piping connections for injection and production wells 24 and 26, steam and utility lines, all of which are located between the injection and production wells 24 and 26. Each well pad 14 may have its own layout.

In multi-well pad drilling, as a well pad comprises a plurality of wells, wellheads and related equipment have to be carefully arranged to fit into the well pad and avoid subsurface wellbore collision. Moreover, it is always desired to drill more wells from a single pad to further reduce the drilling cost, completion time and environmental footprint, and to more efficiently consolidate common facilities. It is therefore an object to provide a novel pad drilling method for drilling multiple wells in a well pad and a multi-well pad drilling system employing the same.

SUMMARY

According to one aspect of this disclosure, there is provided a well pad system comprising: a plurality of interconnected first wellhead connection modules arranged in a linear array and forming a first axis; a plurality of first wellheads forming a first row of wellheads parallel to the first axis and spaced at a first distance thereto; and a plurality of second wellheads forming a second row of wellheads parallel to the first axis and spaced at a second distance to the first axis, said second distance being longer than the first distance; wherein the plurality of first and second wellheads are connected to the plurality of first well connection modules; and wherein the first wellheads are offset laterally from the second wellheads such that each neighboring pair of first wellheads has a second wellhead therebetween, forming an acute-angled triangle.

In one embodiment, both the first wellheads and the second wellheads are on a first side of the first axis.

In another embodiment, each first wellhead connection module has a neighboring first wellhead located laterally on each of the left-hand and right-hand sides thereof and connected thereto, and each two adjacent first wellhead connection modules have two first wellheads therebetween.

In another embodiment, the well pad system further comprises: a plurality of third wellheads on a second side of the first axis opposite to the first side thereof, the third wellheads forming a third row of wellheads parallel to the first axis and spaced at a third distance thereto; and a plurality of fourth wellheads on the second side of the first axis forming a fourth row of wellheads parallel to the first axis and spaced at a fourth distance to the first axis, said fourth distance being longer than the third distance; wherein the plurality of third and fourth wellheads are connected to the plurality of first well connection modules; and wherein the third wellheads are offset laterally from the fourth wellheads such that each neighboring pair of third wellheads has a fourth wellhead therebetween, forming an acute-angled triangle.

In another embodiment, each first wellhead connection module has a neighboring third wellhead located laterally on each of the left-hand and right-hand sides thereof and connected thereto, and each two adjacent first wellhead connection modules have two of third wellheads therebetween.

In another embodiment, the well pad system further comprises: a second wellhead connection module aligning to the plurality of first wellhead connection modules and interconnected therewith, the second wellhead connection module defining a second axis orthogonal to the first axis, the first and second axes forming a coordinate system with an origin at the intersection of the first and second axes, the plurality of first wellhead connection modules on a first side of the second axis; two of fifth wellheads on the first side of the first axis forming a fifth row of wellheads parallel to the first axis and spaced at a fifth distance thereto, the two of fifth wellheads respectively on the first side of the second axis and an opposite second side of the second axis and connected to the second wellhead connection module; and two of sixth wellheads on the first side of the first axis forming a sixth row of wellheads parallel to the first axis and spaced at a sixth distance thereto, the two of sixth wellheads respectively on the first and second sides of the second axis, and connected to the second wellhead connection module, said sixth distance being longer than the fifth distance.

In another embodiment, the well pad system further comprises: two of seventh wellheads on the second side of the first axis forming a seventh row of wellheads parallel to the first axis and spaced at a seventh distance thereto, the two of seventh wellheads respectively on the first and second sides of the second axis and connected to the second wellhead connection module; and two of eighth wellheads on the second side of the first axis forming an eighth row of wellheads parallel to the first axis and spaced at an eighth distance thereto, the two of eighth wellheads respectively on the first and second sides of the second axis and connected to the second wellhead connection module, said eighth distance being longer than the seventh distance.

In another embodiment, the well pad system further comprises: a plurality of interconnected third wellhead connection modules on the second side of the second axis and aligning to the first and second wellhead connection modules; a plurality of ninth wellheads on the first side of the first axis and on the second side of the second axis, the plurality of ninth wellheads forming a ninth row of wellheads parallel to the first axis and spaced at a ninth distance thereto; and a plurality of tenth wellheads on the second side of the first axis and on the second side of the second axis, the plurality of tenth wellheads forming a tenth row of wellheads parallel to the first axis and spaced at a tenth distance to the first axis, said tenth distance being longer than the ninth distance; wherein the plurality of ninth and tenth wellheads are connected to the plurality of third well connection modules; and wherein the ninth wellheads are offset laterally from the tenth wellheads such that each neighboring pair of ninth wellheads has a tenth wellhead therebetween, forming an acute-angled triangle.

In another embodiment, each third wellhead connection module has a neighboring ninth wellhead located laterally on each of the left-hand and right-hand sides thereof and connected thereto, and each two adjacent third wellhead connection modules have two of ninth wellheads therebetween.

In another embodiment, the well pad system further comprises: a plurality of eleventh wellheads on the second side of the first axis and on the second side of the second axis, the plurality of eleventh wellheads forming an eleventh row of wellheads parallel to the first axis and spaced at an eleventh distance thereto; and a plurality of twelfth wellheads on the second side of the first axis and on the second side of the second axis, the plurality of twelfth wellheads forming a twelfth row of wellheads parallel to the first axis and spaced at a twelfth distance to the first axis, said twelfth distance being longer than the eleventh distance; wherein the plurality of eleventh and twelfth wellheads are connected to the plurality of third well connection modules; and wherein the eleventh wellheads are offset laterally from the twelfth wellheads such that each neighboring pair of eleventh wellheads has a twelfth wellhead therebetween, forming an acute-angled triangle.

In another embodiment, each third wellhead connection module has a neighboring eleventh wellhead located laterally on each of the left-hand and right-hand sides thereof and connected thereto, and each two adjacent third wellhead connection modules have two of eleventh wellheads therebetween.

According to another aspect of this disclosure, there is provided a well pad system having a first axis and a second axis orthogonal to the first axis, the first and second axes defining a coordinate system having four quadrants and an origin at the intersection of the first and second axes. The system comprises: a plurality of interconnected first wellhead connection modules arranged in a linear array along the first axis; and in at least one of the four quadrants, a plurality of first wellheads forming a first row of wellheads parallel to the first axis and spaced therefrom; and a plurality of second wellheads forming a second row of wellheads parallel to the first axis and spaced therefrom, the distance between the second row of wellheads and the first axis being greater than that between the first row of wellheads and the first axis; wherein the plurality of first and second wellheads are connected to the plurality of first well connection modules; and wherein the first wellheads are offset laterally from the second wellheads such that each neighboring pair of first wellheads has a second wellhead therebetween, forming an acute-angled triangle.

In one embodiment, each first wellhead connection module has a neighboring first wellhead located laterally on each of the left-hand and right-hand sides thereof and connected thereto, and each two adjacent first wellhead connection modules have two first wellheads therebetween.

In another embodiment, the well pad system further comprises: a second wellhead connection module centered at the origin, the second wellhead connection module aligning to the plurality of first wellhead connection modules and interconnected therewith; two of third wellheads on a first side of the first axis forming a third row of wellheads parallel to the first axis and spaced therefrom, the two of third wellheads respectively on the first side of the second axis and an opposite second side of the second axis and connected to the second wellhead connection module; and two of fourth wellheads on the first side of the first axis forming a fourth row of wellheads parallel to the first axis and spaced therefrom, the distance between the fourth row of wellheads and the first axis being greater than that between the third row of wellheads and the first axis, the two of fourth wellheads respectively on the first and second sides of the second axis and connected to the second wellhead connection module.

In another embodiment, the well pad system further comprises: two of fifth wellheads on a second side of the first axis opposite to the first side, the two of fifth wellheads forming a fifth row of wellheads parallel to the first axis and spaced therefrom, the two of fifth wellheads respectively on the first and second sides of the second axis and connected to the second wellhead connection module; and two of sixth wellheads on the first side of the first axis forming a sixth row of wellheads parallel to the first axis and spaced therefrom, the distance between the sixth row of wellheads and the first axis being greater than that between the fifth row of wellheads and the first axis, the two of sixth wellheads respectively on the first and second sides of the second axis and connected to the second wellhead connection module.

In another embodiment, each first wellhead is paired with an immediate neighboring second wellhead forming a well pair, the well pair forming a well pair vector from the first wellhead thereof to the second wellhead thereof, the projection of the well pair vector onto the first axis pointing away from the origin and the projection of the well pair vector onto the second axis also pointing away from the origin.

According to another aspect of this disclosure, there is provided a well pad system comprising: a module defining a first axis along a side of the module and a second axis crossing the center of the module and orthogonal to the first axis, said first and second axes forming a coordinate system; and at least a first wellhead and a second wellhead in a same quadrant of the coordinate system, and connected to the module.

According to another aspect of this disclosure, there is provided a module component for connecting to a pair of wellheads, the module component comprising: a first layer having one or more headers for coupling to one or more pipes; and a second layer on top of the first layer, the second layer having one or more valves coupling to the one or more headers in the first layer.

In one embodiment, the module component further comprises: a third layer on top of the second layer, the third layer having oil and/or gas lifting and recovery equipment.

In another embodiment, the second layer comprises connectors for connecting to a pair of wellheads.

According to another aspect of this disclosure, there is provided a well pad system having a first axis and a second axis orthogonal to the first axis, the first and second axes defining a coordinate system having four quadrants and an origin at the intersection of the first and second axes. The system comprises: a plurality of interconnected first wellhead connection modules arranged in a linear array along the first axis; and in each of N of the four quadrants, N being an integer between 1 and 4, inclusive, a plurality of first wellheads forming a first row of wellheads parallel to the first axis and spaced therefrom with a distance of a positive number Y/2; and a plurality of second wellheads forming a second row of wellheads parallel to the first axis and spaced therefrom with a distance of a positive number Y/2+Z; wherein the plurality of first and second wellheads are connected to the plurality of first well connection modules; and wherein the first wellheads are offset laterally from the second wellheads such that each neighboring pair of first wellheads has a second wellhead therebetween, forming an acute-angled triangle.

In one embodiment, each first wellhead connection module has a neighboring first wellhead located laterally on each of the left-hand and right-hand sides thereof and connected thereto, and each two adjacent first wellhead connection modules have two first wellheads therebetween.

In another embodiment, the well pad system further comprises: a second wellhead connection module centered at the origin, the second wellhead connection module aligning to the plurality of first wellhead connection modules and interconnected therewith; two of third wellheads on a first side of the first axis forming a third row of wellheads parallel to the first axis and spaced therefrom, the two of third wellheads respectively on the first side of the second axis and an opposite second side of the second axis and connected to the second wellhead connection module; and two of fourth wellheads on the first side of the first axis forming a fourth row of wellheads parallel to the first axis and spaced therefrom, the distance between the fourth row of wellheads and the first axis being greater than that between the third row of wellheads and the first axis, the two of fourth wellheads respectively on the first and second sides of the second axis and connected to the second wellhead connection module.

In another embodiment, the well pad system further comprises: two of fifth wellheads on a second side of the first axis opposite to the first side, the two of fifth wellheads forming a fifth row of wellheads parallel to the first axis and spaced therefrom, the two of fifth wellheads respectively on the first and second sides of the second axis and connected to the second wellhead connection module; and two of sixth wellheads on the first side of the first axis forming a sixth row of wellheads parallel to the first axis and spaced therefrom, the distance between the sixth row of wellheads and the first axis being greater than that between the fifth row of wellheads and the first axis, the two of sixth wellheads respectively on the first and second sides of the second axis and connected to the second wellhead connection module.

In another embodiment, in each of the N quadrants, each first wellhead is paired with an immediate neighboring second wellhead forming a well pair, the well pair forming a well pair vector from the first wellhead thereof to the second wellhead thereof, the projection of the well pair vector onto the first axis pointing away from the origin and the projection of the well pair vector onto the second axis also pointing away from the origin.

In another embodiment, N is greater than 1; and the Y/2 in a first one of the N quadrants is the same as the Y/2 in a second one of the N quadrants.

In another embodiment, N is greater than 1; and the Y/2 in a first one of the N quadrants is different than the Y/2 in a second one of the N quadrants.

In another embodiment, Y is a value between about 6 m and about 30 m, inclusive.

In another embodiment, Y is a value between about 6 m and about 24 m, inclusive.

In another embodiment, N is greater than 1; and the distance between the first and second rows of wellheads is Z, and the Z in a first one of the N quadrants is the same as the Z in a second one of the N quadrants.

In another embodiment, N is greater than 1; and the distance between the first and second rows of wellheads is Z, and the Z in a first one of the N quadrants is different than the Z in a second one of the N quadrants.

In another embodiment, in each of the N quadrants, each pair of adjacent first wellheads connected to the same wellhead connection module are spaced by a first distance X1, and each pair of adjacent first wellheads connected to different wellhead connection modules are spaced by a second distance X2.

In another embodiment, X1 is equal to X2.

In another embodiment, X1 is different than X2.

In another embodiment, X2 is smaller than X1.

In another embodiment, either of X1 and X2 is a value between about 6 m and about 30 m, inclusive.

In another embodiment, either of X1 and X2 is a value between about 6 m and about 24 m, inclusive.

In another embodiment, N is greater than 1, and, in each of the N quadrants, the distance along the first axis between each first wellhead and the neighboring second wellhead on the second-axis side thereof is D, and D is a same value for all N quadrants.

In another embodiment, D is a value between about 1 m and about 20 m, inclusive.

In another embodiment, D is a value between about 1 m and about 15 m, inclusive.

In another embodiment, the well pad system is a Steam Assisted Gravity Drainage (SAGD) well pad system.

In another embodiment, for each well pair in each of the N quadrants, the first wellhead thereof is an injection wellhead, and the second wellhead thereof is a production wellhead.

Herein, "the neighboring B of A" means that B is the immediate neighboring of A, with no intermediary element of the same type as B between A and B.

BRIEF DESCRIPTION OF THE DRAWINGS

In the following figures, all measurements shown therein are in meters.

FIG. 22 is a table showing well parameters of a well pad system in various embodiments;

DETAILED DESCRIPTION

Herein, the well pad system is described in the context of the heavy oil recovery process of Steam Assisted Gravity Drainage (SAGD). SAGD is characterized by well pairs, each comprising an injection well and a production well. Those skilled in the art appreciate that the well pad system described herein may also be used for other suitable oil and gas production.

Each wellhead on the surface is coupled to and corresponds to a subsurface well or wellbore. In the embodiments described below, each well is a horizontal well that is first vertically or slant drilled to a predetermined depth and transits to a horizontal direction. However, those skilled in the art appreciate that the well pad system and related pad drill method disclosed herein can also be used for vertical wells.

Similar to the existing well pad system of FIGS. 1A to 1G, the well pad system disclosed herein also comprises a plurality of wellheads and wellhead connection modules. However, as will be described in more detail below, the well pad system disclosed herein has a unique surface structure with dense wellheads, allowing more subsurface wellbores to be drilled using known directional drilling technologies. Moreover, in some embodiments, the wellhead connection module is further modularized and comprises standardized wellhead connection submodules, or alternatively called wellhead connection module components, suitable for road transport and quick on-site assembling.

Well Pad Surface Structure

Figure 1A:
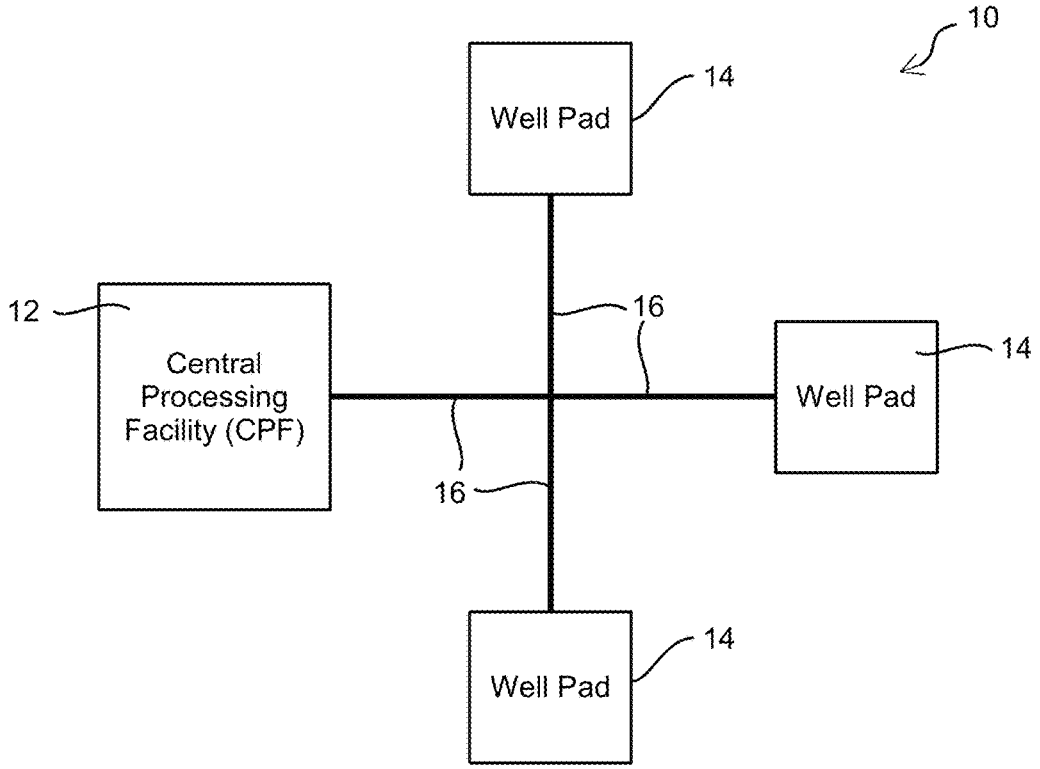
FIG. 1A (Prior art)
FIG. 1A illustrates a prior-art pad system having a central processing facility and a conventional arrangement of a plurality of well pads connected to one processing facility.
Figure 1B:
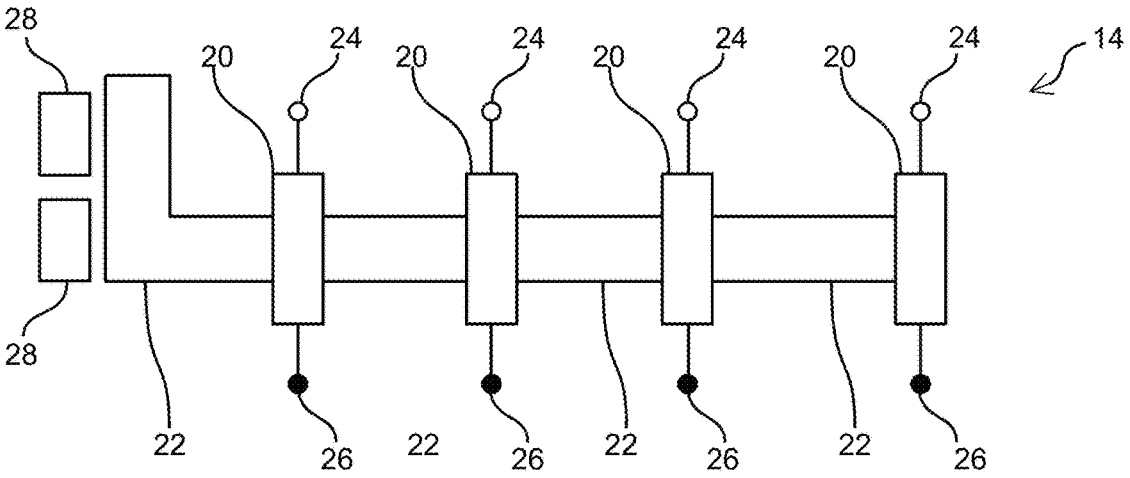
FIG. 1B (Prior art)
FIGS. 1B to 1D illustrate a pad of the prior-art well pad system of FIG. 1A.
Figure 1C:
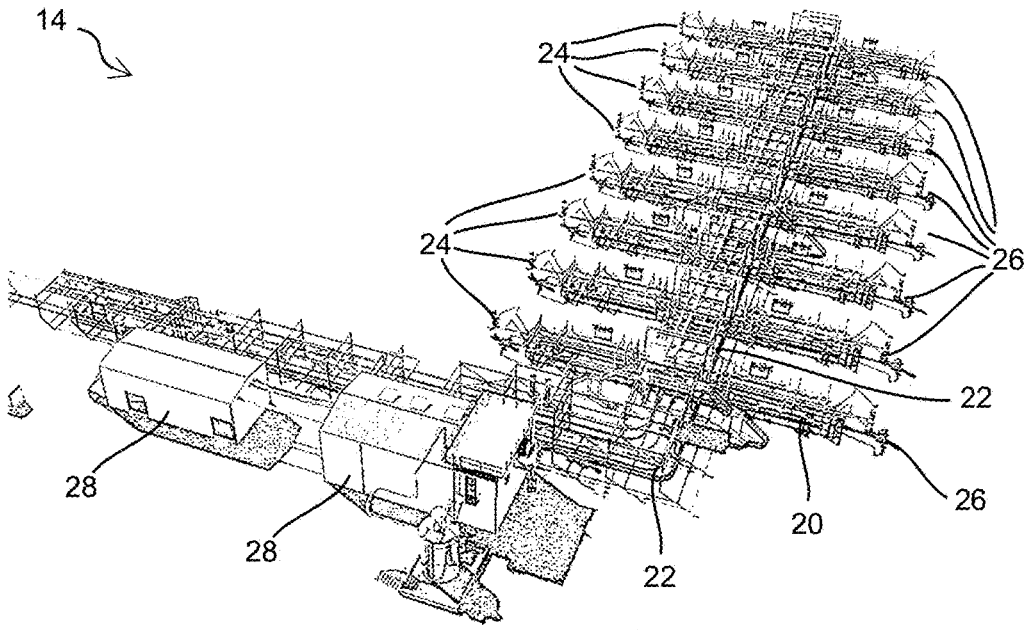
FIG. 1C (Prior art)
Figure 1D:
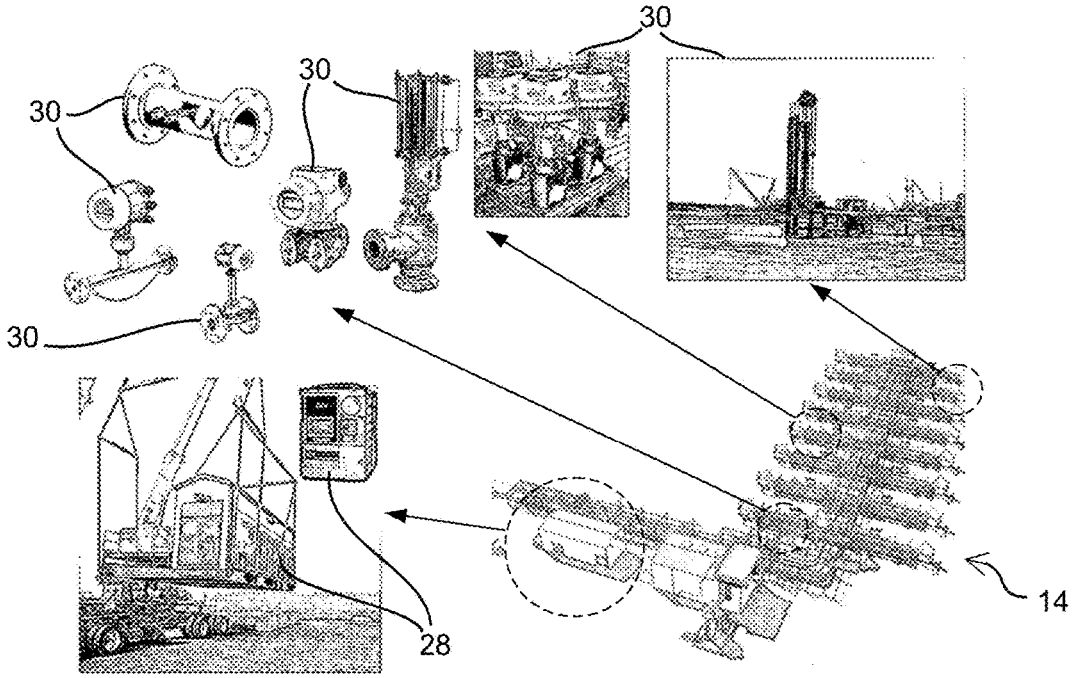
FIG. 1D (Prior art)
Figure 1E:
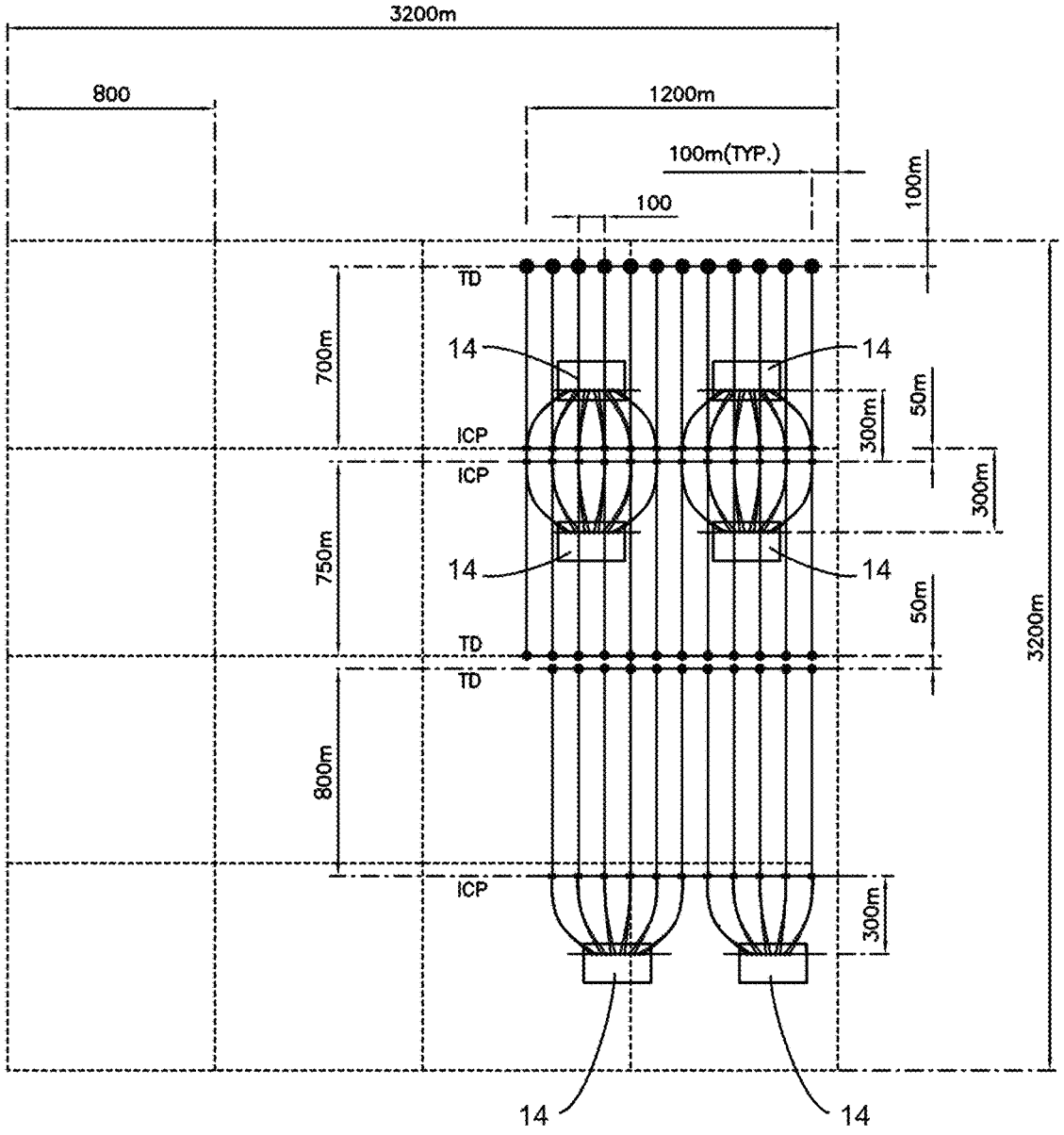
FIG. 1E (Prior art)
FIGS. 1E to 1G show a job site having a plurality of wells, and the well paths thereof, deployed using the prior-art well pad system of FIG. 1A.
Figure 1F:
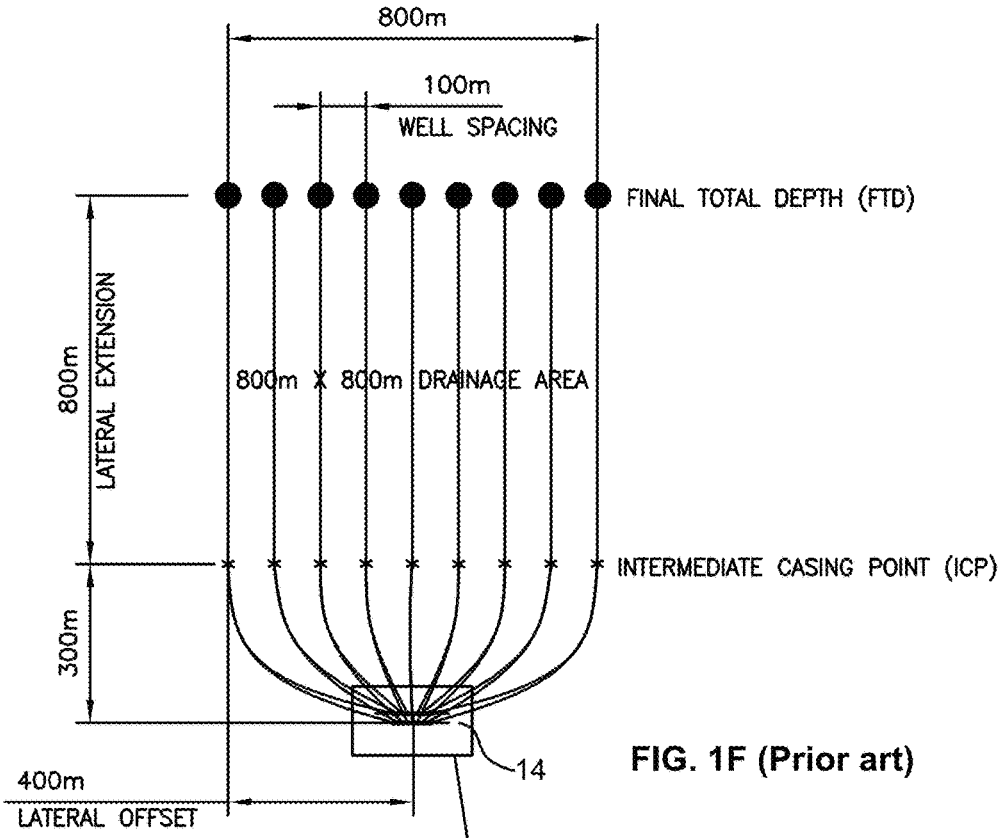
FIG. 1F (Prior art)
Figure 1G:
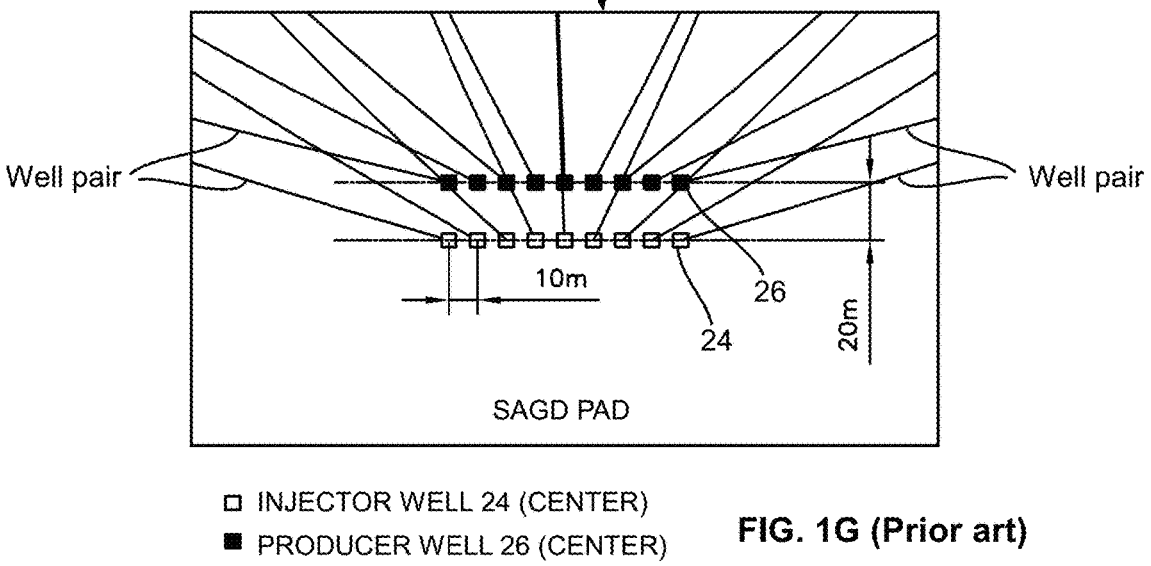
FIG. 1G (Prior art)
Figure 2:
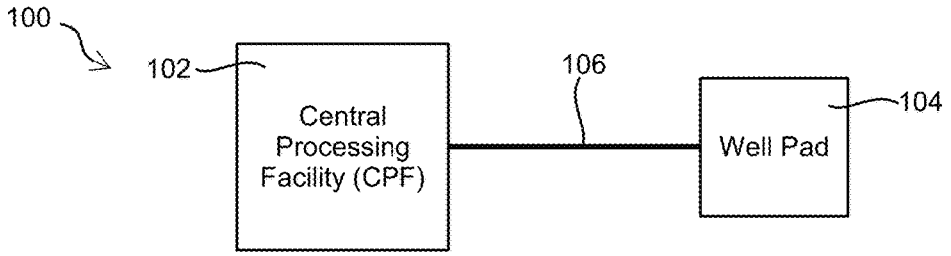
FIG. 2 illustrates a pad system having a reduced number of well pads using a dual row well pair layout, one shown, to replace the multiple well pads of FIG. 1A.

Herein, and with reference to FIG. 2, the conventional use of a multiplicity of well pads 14, 14, . . . , and the total well pad area consumed for a site can be reduced significantly with a compact, modularized multi-well pad system and a multi-well pad drilling method disclosed herein. For example, where a conventional system might use a minimum of 2 to 6 well pads for 10,000 barrels per day (bpd) production, each pad having 6 to 8 well pairs, herein one well pad having 20 to 36 well pairs can now be provided. In embodiments, each well pair and up to four well pairs can be serviced by the modularized wellhead connection submodules. Each submodule comprises a pair of connectors for connecting to a pair of injection and production wellheads, respectively, and up to four submodules can be combined, without modification of the submodule structure, to form a wellhead connection module and manage one, two, three and four well pairs. Piping modules, generally comprising pipelines, extend generally aligned for transmission of utilities and product to and from a CPF. Extending transverse to the piping modules, and spaced periodically therealong, are wellhead connection modules (formed by one to four submodules) that service well pairs. Herein, a well planning and well spacing method is also disclosed for well pair arrangements using a carefully designed well spacing pattern, however generally, two sets of well pairs are now generally aligned along the well drill direction where only one well pair was previously provided in the prior art.

The well pad solution has an initial capital reduction of up to 75%, reducing conventional 2 year project timeline of greater than 50% and a life cycle operational reduction of up to 25%.

For example, one can combine three (3) conventional well pads into one (1) herein-disclosed well pad, by drilling up 36 well pairs in 3 different directions, which gives rise to a 66% or ⅔ reduction in the number of well pads required for a multi-pad development. With the system and method disclosed herein, one can have 24 well pairs drilled in one direction, 24 well pairs in two directions, or 36 well pairs in three directions.

Each wellhead connection submodule has a predetermined arrangement that is simply a plug-and-play design. As well pairs are needed, the submodules are added. Two types of wellhead connection submodules are provided, with one type generally being a mirrored configuration to the other. Therefore, with mixture of the two types, two (2), three (3), or four (4) wellhead connection submodules may be assembled side-by-side and/or end-to-end for 2, 3, or 4 well pair operations. Of course, a submodule of either type may also be used individually for one (1) well pair operation, typically added to a plurality of assembled modules.

In one embodiment, either type of the submodules has a minimum of two vertically stacked layers: a bottom header layer that is placed atop the piping modules for standardized connection thereto, and a control layer stacked atop the header layer for housing isolation and control valving as a base case for all of the wellhead injection and production needs. A third, optional layer is provided for stacking atop the control layer and provides project-specific, enhanced oil recovery capabilities including gas lift, solvent aided process, dewatering, and other optional components.

Each submodule is designed for a well pair and sized for road transport, generally along the lines of sea can dimensions, e.g., suitable for fitting into a standard transportation box with dimension of 8'×8'×53'. As described above, a wellhead connection module can be assembled using 1, 2, 3 or 4 submodule blocks for 1, 2, 3, or 4 well pair operations. Each submodule then has standardized external wellhead connections to its well pair and internal pipeline connections to the piping modules. Modules can be transported and dropped individually on site with access provided between adjacent drilled well pairs. Further, site preparation staging is easily managed as individual modules can be delivered to a pre-staging side, pre-assembled in multiples and pre-commissioned before placement on the well pad. Submodules utilize standardized linking connections for temporary module-to-module pinning during piping connection aiding in scheduling with full permanent connection made in due course.

Submodule connections are standardized based on basic criteria per client requirements. Basic Piping and Instrumentation Diagrams (PIDs) for each submodule and layer are standardized, with some variations such as for pipe sizes. The process design is locked with options for high or low flow configurations. Process input that dictates pipe sizing include: Steam to Oil ratio (SOR), Gas to Oil ratio (GOR), Produced Water to Steam Ratio (PWSR), and well flow rates. The design is adapted to a number of well pair by adding additional submodules.

While connections are standardized, submodules for one site might be sized for 8" piping while another site for 10" piping. Standardized packages also enable enhanced quality control and maintenance of inventory for faster response in design and replacement.

As shown in FIG. 2, similar to the prior art system 10, the well pad system 100 comprises a CPF 12 coupled to at least one well pad 104 via pipelines 106. However, through application of the embodiments discussed herein, multiple prior art well pads 14 of FIG. 1A can now be consolidated into a fewer or even one smaller pad 104 with economic savings realized through fewer duplication of facilities and support infrastructure previously required for multiple, spaced apart pads 14.

Figure 3A:
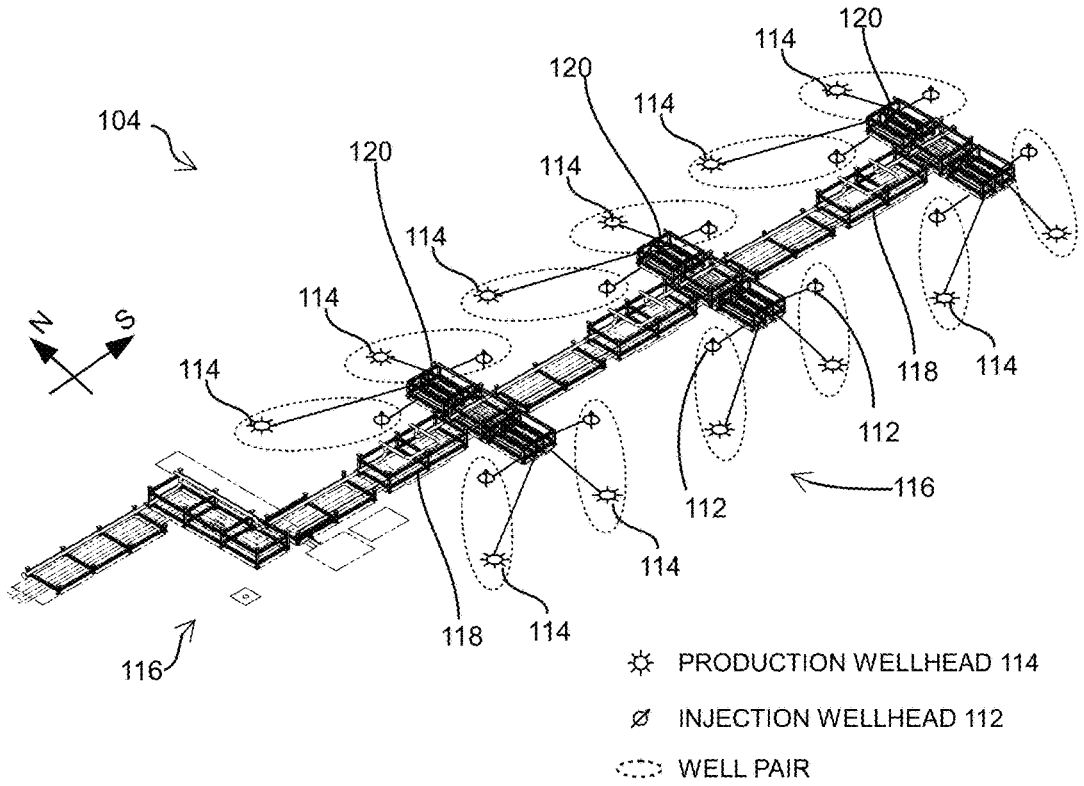
FIG. 3A is a perspective view of a portion of a well pad system of FIG. 2, according to one embodiment.
Figure 3B:
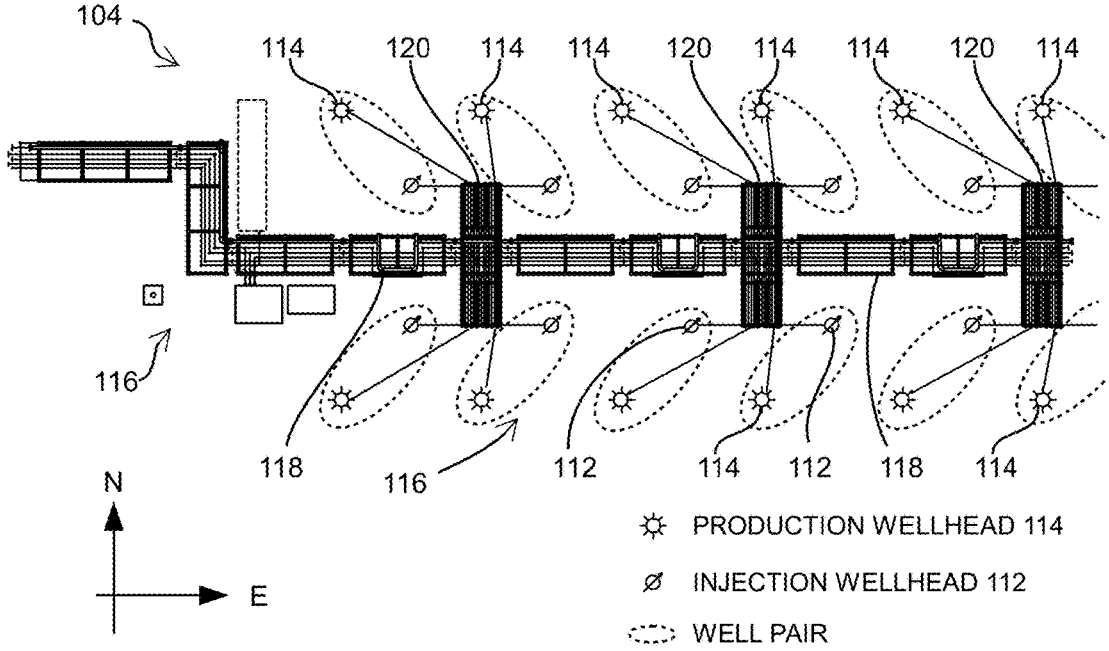
FIG. 3B is a plan view of a portion of the well pad system of FIG. 3A.
Figure 3C:
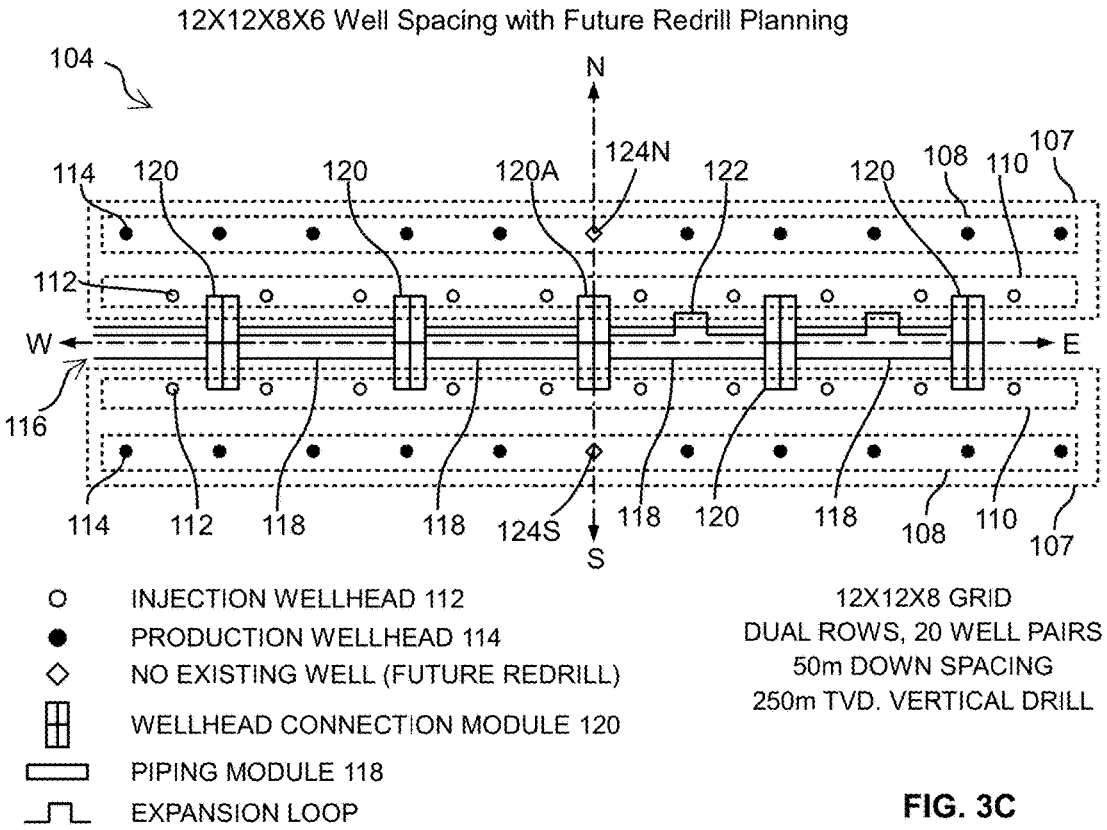
FIG. 3C is a schematic diagram of the portion of the well pad system of FIG. 3A.
Figure 3D:
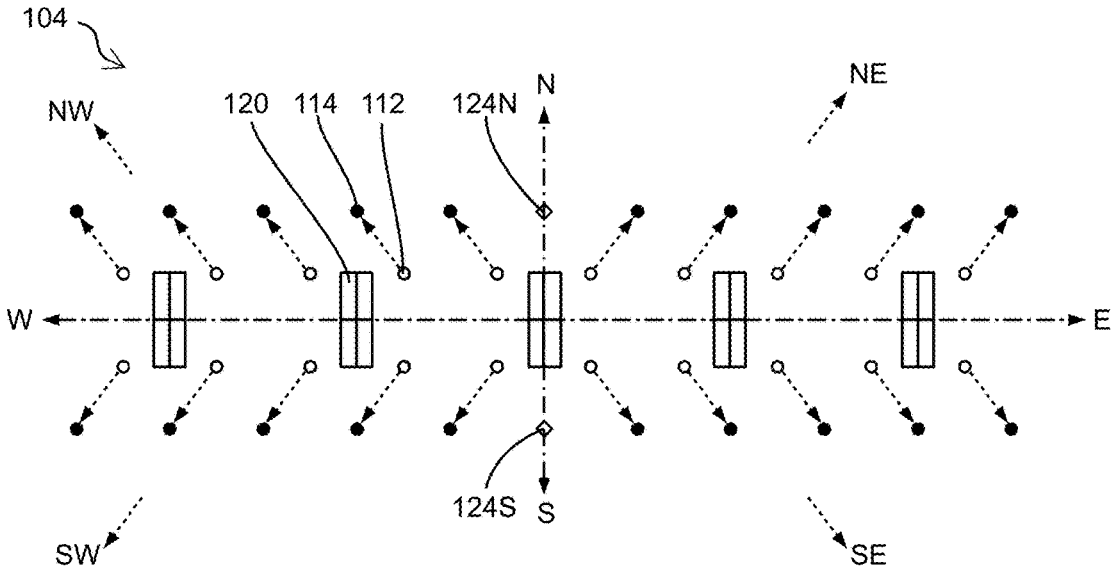
FIG. 3D is a simplified schematic diagram of the portion of the well pad system of FIG. 3A for illustrating well pair vectors.
Figure 3E:
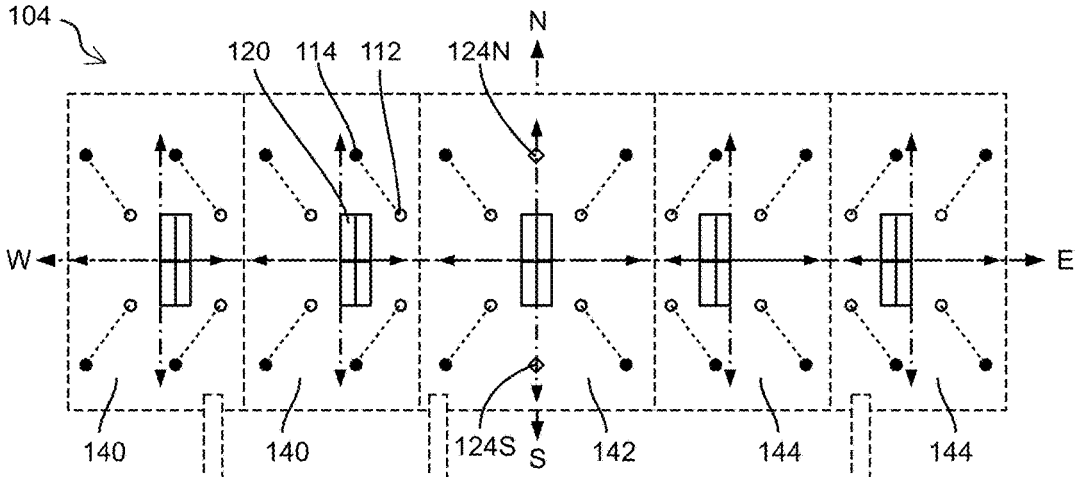
FIGS. 3E to 3H are simplified schematic diagrams of the portion of the well pad system of FIG. 3A, for illustrating the relationship between wellhead connection modules and well pairs.
Figure 3F:
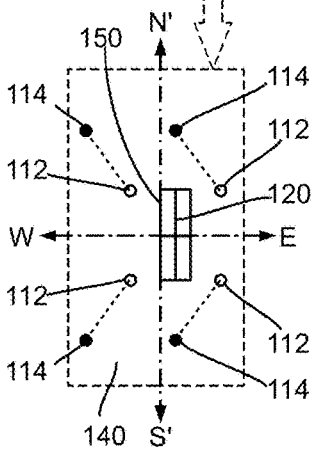
Figure 3G:
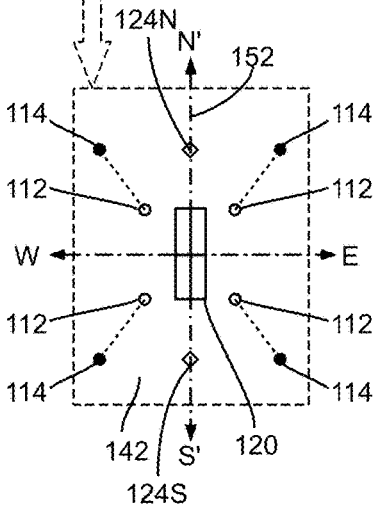
Figure 3H:
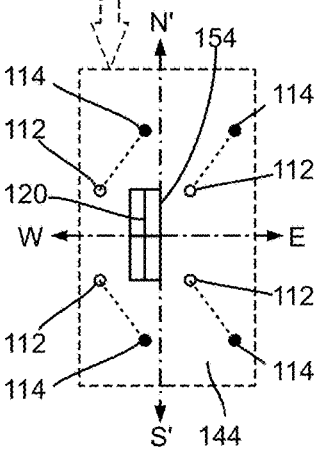
Figure 3I:
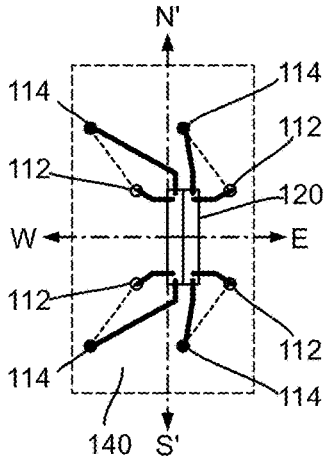
FIGS. 3I to 3K are simplified schematic diagrams of the portion of the well pad system of FIG. 3A, for illustrating the connections between wellhead connection modules and well pairs.
Figure 3J:
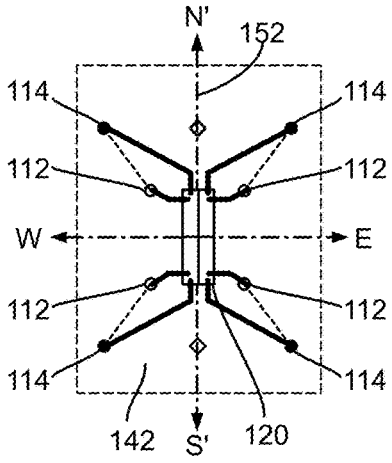
Figure 3K:
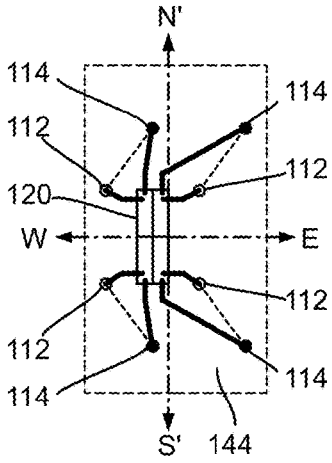
Figure 3L:
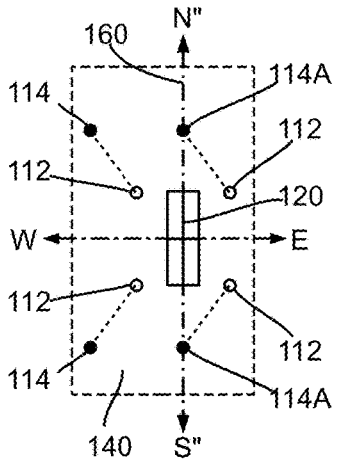
FIGS. 3L to 3N are alternative simplified schematic diagrams of the portion of the well pad system of FIG. 3A, for illustrating the relationship between wellhead connection modules and well pairs.
Figure 3M:
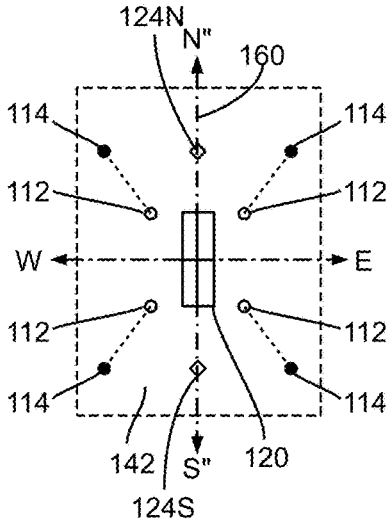
Figure 3N:
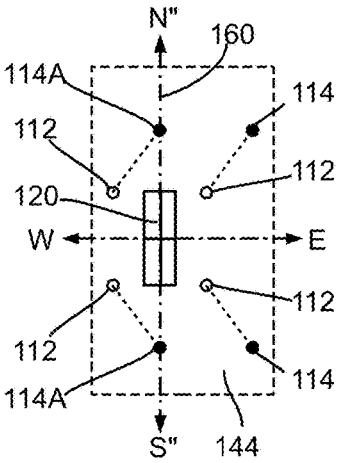

FIGS. 3A to 3N show a portion of a well pad 104 of the pad system 100, according to one embodiment. As shown, the well pad 104 comprises 20 well pairs (12 well pairs shown in FIGS. 3A and 3B), each well pair having an injection wellhead 112 and a production wellhead 114. The well pairs are deployed in two well pair rows; the two well pair rows symmetrically positioned on each of the two sides of a pipe-rack system 116, denoted as a Parallel Dual Row system hereinafter. Similar to the conventional well pad 10 of FIGS. 1A to 1G, the well pad 104 may also comprise one or more on-site processing facilities (not shown).

The pipe-rack system 116 comprises a plurality of piping modules 118 for thermal injection/production piping, and a plurality of wellhead connection modules 120, alternately coupled to each other in serial, and arranged in a linear array. The pipe-rack system 116 may also comprise periodic expansion loops 122. The piping modules 118 comprise a plurality of pipes, e.g., a steam pipe, a test pipe, an emulsion pipe, a casing gas pipe, a fuel gas pipe and an air pipe, and are connected to the CPF 102. The piping modules 118 may also comprise pipes for water, solvent and for testing. Each piping module 118 connects its pipes to the wellhead connection modules 120. Each wellhead connection module 120 connects to a one or more well pairs via suitable pipes. Hereinafter, pipes connecting wellheads 112/114 of well pairs to wellhead connection modules 120 are represented in drawings using oblique lines. However, those skilled in the art appreciate that, the oblique lines are for illustrative purpose only, and in practice, piping with right angle connections is usually used for connecting the wellheads 12/114 to the wellhead connection module 120.

For ease of description and relative orientation of components, the row of the piping modules 118 and wellhead connection modules 120 (denoted as "row of modules" hereinafter) defines a West-East (W-E) axis, crossing the centers of the wellhead connection modules 120 (FIG. 3C). A central wellhead connection module 120A aligns along a South-North (S-N) axis orthogonal to the W-E axis. Thus, the W-E and S-N axes form a well pad coordinate system in the four cardinal directions, with a virtual origin at the intersection of the W-E and S-N axes. Those skilled in the art appreciate that the terms "NORTH", "SOUTH", "EAST" and "WEST" are used herein for descriptive relative orientation purposes only, and need not dictate actual site orientation.

With such a well pad coordinate system, the well pad 104 is divided into four well pad quadrants (sometimes also denoted as well pair/well pad quadrants), i.e., an NE, an SE, an NW and an SW quadrant. The NE and NW quadrants form an area on the NORTH side of the W-E axis, and the SE and SW quadrants form an area on the SOUTH side of the W-E axis. The NE and SE quadrants form an area on the EAST side of the S-N axis, and the NW and SW quadrants form an area on the WEST side of the S-N axis.

As shown in FIG. 3C, the wellheads 112 and 114 are distributed in the four quadrants and connected to the wellhead connection modules 120. In particular, for well pad 104, the wellheads 112 and 114 form two rows of well pairs (well pair rows) 107 on each of the NORTH and SOUTH sides of the W-E axis, respectively, arranged parallel to the W-E axis. The NORTH and SOUTH well pair rows 107 are mirrored to each other, and each well pair row 107 further comprises a row of production wellheads 114, denoted as a production row 108 (see FIG. 3C, excluding the future well 124N or 124S), and a row of injection wellheads 112, denoted as an injection row 110. In each of the two production rows 108 and the two injection rows 110, the wellheads 114/112 on the EAST side of the S-N axis are mirrored to those on the WEST side thereof. The piping modules 118 and the wellhead connection modules 120 are deployed along the W-E axis, and with equal distance to the NORTH and SOUTH well pair rows 107. As discussed later, the mirroring is effective in avoiding wellbore collision.

In this embodiment, in each of the NORTH and SOUTH sides of the W-E axis, the production wellheads 114 are deployed in an outer row 108 and the injection wellheads 112 are deployed in an inner row 110. In other words, the production wellheads 114 are positioned with an N-S offset of a longer distance to the piping modules 118 or the wellhead connection modules 120 compared to the injection wellheads 112.

Moreover, the injection wellheads 112 are positioned in a W-E offset manner with respect to the production wellheads 114 such that each injection wellhead 112 has a left-hand and a right-hand neighboring production wellheads 114 on the left and right hand sides thereof, respectively, such that, in each quadrant, each injection wellhead 112 (except the injection wellhead 112 closest to the virtual origin) and its two neighboring production wellheads 114 form an acute-angled triangle, i.e., all internal angles of the so-formed triangle are acute angles. Also, in each quadrant, each production wellhead 114 (except the production wellhead 114 farthest to the virtual origin) and its two neighboring injection wellheads 114 form an acute-angled triangle.

Each injection wellhead 112 is paired with a production wellhead 114. As shown in FIG. 3D, each wellhead pair form a well pair vector from the injection wellhead 112 to the production wellhead 114 generally pointing away from the origin of the well pad coordinate system. That is, the projection of the well pair vector onto the W-E axis pointing away from the origin and the projection of the well pair vector onto the S-N axis also pointing away from the origin. In particular, each wellhead pair in the NE quadrant form a well pair vector pointing to the North-East; each wellhead pair in the NW quadrant form a well pair vector pointing to the North-West; each wellhead pair in the SE quadrant form a well pair vector pointing to the South-East; and each wellhead pair in the SW quadrant form a well pair vector pointing to the South-West.

As shown in FIG. 3E, the well pad 104 may also be partitioned to a plurality of wellhead-piping sections, comprising one or more left-hand wellhead-piping sections 140 on the WEST side of the S-N axis, a central wellhead-piping section 142 and one or more right-hand wellhead-piping sections 144 on the EAST side of the S-N axis. For ease of description, a section coordinate system may also be defined for each of the wellhead-piping sections 140, 142, and 144.

As shown in FIGS. 3E and 3F, each left-hand wellhead-piping section 140 comprises a wellhead connection module 120 and four well pairs 112/114. A left-hand side 150 of the wellhead connection module 120 defines an S'-N' axis of section 140 orthogonal to the previously defined W-E axis. The S'-N' and W-E axes therefore define a section coordinate system for the left-hand wellhead-piping section 140 having four (4) quadrants. As shown, each quadrant of the left-hand wellhead-piping section 140 comprises a well pair 112/114.

As shown in FIG. 3G, the central section 142 comprises a wellhead connection module 120 and four well pairs 112/114. The wellhead connection module 120 has a longitudinal axis 152 defining an S'-N' axis of section 142 orthogonal to the previously defined W-E axis. The S'-N' and W-E axes define a section coordinate system for the central wellhead-piping section 142 having four (4) section quadrants. Each section quadrant of the left-hand wellhead-piping section 142 comprises a well pair 112/114.

As shown in FIG. 3H, each right-hand section 144 comprises a wellhead connection module 120 and four well pairs 112/114. A right-hand side 154 of the wellhead connection module 120 defines an S'-N' axis of section 144 orthogonal to the previously defined W-E axis. The S'-N' and W-E axes therefore define a section coordinate system for the right-hand wellhead-piping section 144 having four (4) section quadrants. Each section quadrant of the right-hand wellhead-piping section 144 comprises a well pair 112/114.

Referring again to FIGS. 3C to 3E and 3G, with above-described wellhead and module configuration, the two production wellheads 114 on each of the NORTH and SOUTH sides of the W-E axis are spaced with a sufficient rig access distance such that a future well 124N, 124S, if needed, may be drilled in the future therebetween at the intersection of the production row 108 and the S'-N' axis of the central section 142. The two future wells 124N and 124S may form a well pair with one being an injection well and the other being a production well, or may alternatively be two independent wells, depending on the system need and implementation. For example, any or both of the two future wells 124N and 124S may be drilled as a replacement well for a failed thermal well.

FIGS. 3I to 3K show the connections between wellhead pairs 112/114 and the wellhead connection module 120 in sections 140, 142 and 144, respectively. As shown, in each of sections 140, 142 and 144, each wellhead pair 112/114 is connected adjacent a corner of the wellhead connection module 120 via suitable piping (represented by the thick, oblique lines).

FIGS. 3L to 3N show an alternative characterization of the sections 140, 142 and 144 in this embodiment. Each wellhead connection module 120 has a longitudinal axis 160 defining an S"-N" axis orthogonal to the W-E axis. The S"-N" axis and the W-E axis then form a section coordinate system with four quadrants. Among the four production wellheads, two production wellheads 114A (one on the NORTH side of the W-E axis and the other on the SOUTH side of the W-E axis) are generally located along the S"-N" axis. If one considers that each of the section quadrants N"E, N"W, S"E and S"W includes the corresponding half of the S"-N" axis, each section quadrant comprises a well pair 112/114.

Figure 4A:
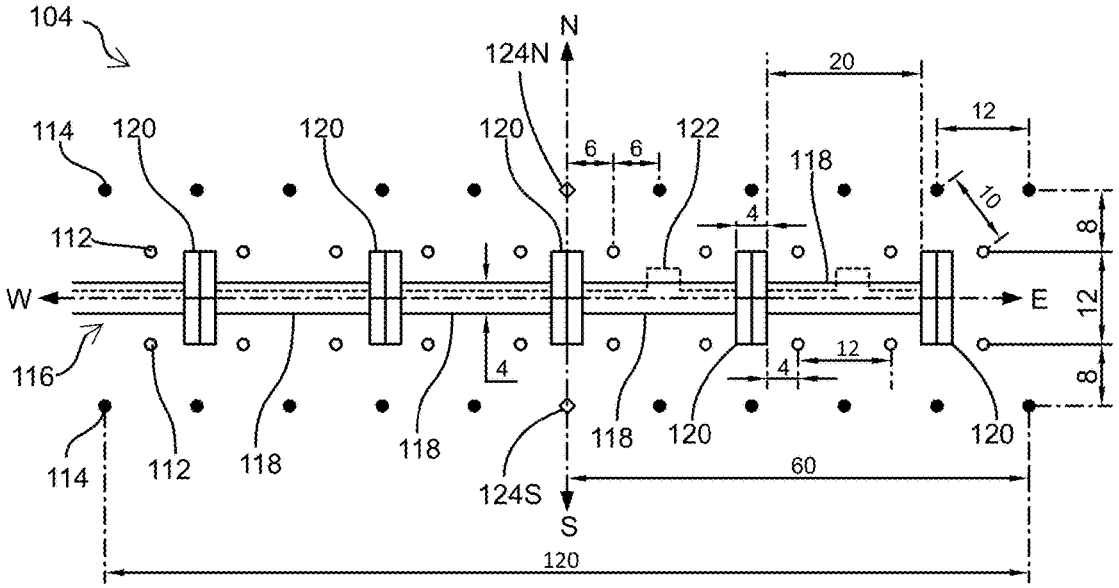
FIGS. 4A and 4B are simplified schematic diagrams of the portion of the well pad system of FIG. 3A, showing some dimensions and measurements of the well pad system.
Figure 4B:
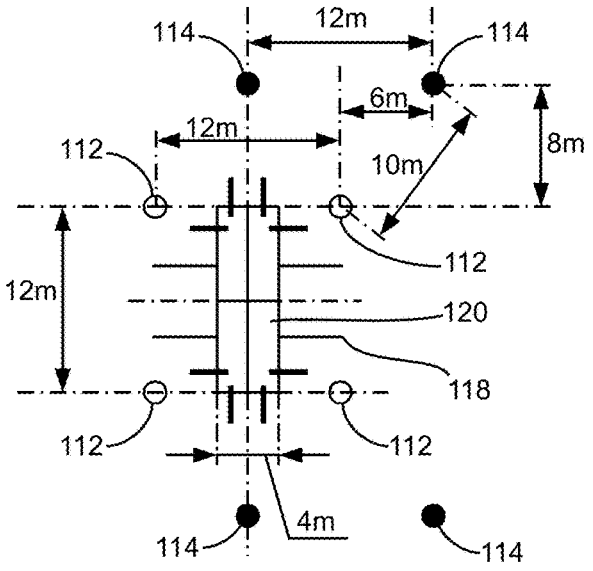

Illustrative of the compact module spacing, and, as shown in FIGS. 4A and 4B, in this embodiment, the two injection rows 110 are spaced by about 12 m, and are centered about the W-E axis. The distance between each injection row 110 and its neighboring production row 108 is about 8 m.

In each production row 108, the distance between two neighboring production wellheads 114 is about 12 m. In each injection row 110, the distance between two neighboring injection wellheads 112 is also about 12 m. Each injection wellhead 112 is of the same distance of 10 m to the neighboring production wellheads on its left and right hand sides, respectively. Therefore, each injection wellhead 112 (except the two injection wellheads 112 closest to the S-N axis) and its two neighboring production wellheads 114 form an equilateral triangle (which is a special type, acute angled triangle), and each production wellhead 114 (except the two production wellheads 114 farthest to the S-N axis) and its two neighboring injection wellheads 112 also form an equilateral triangle.

Each piping module 118 has a dimension of about 4 m (along the S-N axis) by about 20 m (along the W-E axis), and is centered above the W-E axis. Currently, the steam lines between the wellhead connection modules 120 require minimum 8 m spacing between wells to fit a strain-relieving, surface piping expansion loop between them, and to meet setback distances and rig spacing requirements required by regulations, e.g., Occupational Health and Safety (OHS).

Each wellhead connection module 120 has rectangular shape and has a width of about 4 m and a length of about 12 m, and is centered about and coupled to four (4) neighboring injection wellheads 112 (two injection wellheads on the NORTH side of the W-E axis and two injection wellheads on the SOUTH side thereof). Thus, each NORTH injection wellhead 112 is spaced from the neighboring wellhead connection module 120 by 4 m, and aligned with a NORTH side thereof, and each SOUTH injection wellhead 112 is spaced from the neighboring wellhead connection module 120 by 4 m, and aligned with a SOUTH side thereof. With such a 4 m distance, while the injection wells 112 cannot be re-entered by a drilling rig without removal of a wellhead connection module 120 or a submodule thereof (described later) as required, well servicing operations such as pump changes and tubing replacements are still be able to be applied to the injection wells 112. As each pair of neighboring wellhead connection modules 120 are spaced by 20 m (i.e., the length of the piping module 118), four neighboring injection wellheads 112 (two injection wellheads on the NORTH side of the W-E axis and two injection wellheads on the SOUTH side thereof) are deployed therebetween.

As production wellheads 114 are spaced with much greater distance from the wellhead connection module 120, they allow full drilling rig access with the disconnection of the steam injection and emulsion production lines from surface facilities, for the purpose of re-entering the wells 114 for various production performance related reasons. For typical drilling rigs, there requires a minimum of 10 m from the well center to the back of the drilling rig, across the entire width of the rig. Such a minimum requirement, however, may be smaller if one uses purposively-built rigs, e.g., elevated rigs that setup above the wellheads. Angling of a rig is rendered difficult or prohibited due the presence of mud tanks on one side and the pipe-racks on the other. Furthermore, a minimum of 30 m clearance from the outer, production row 108 to the edge of the useable lease (pad edge) is required to allow the rest of the rig equipment to be placed and still have room to navigate past the end of the catwalk, choke manifold and flare tank. In some embodiments, such a minimum clearance may be larger, e.g., up to 100 m.

With the above spacing dimensions, the distance between the future well location 124N, 124S and either of its two neighboring production wellhead 114 is about 12 m.

Figure 5:
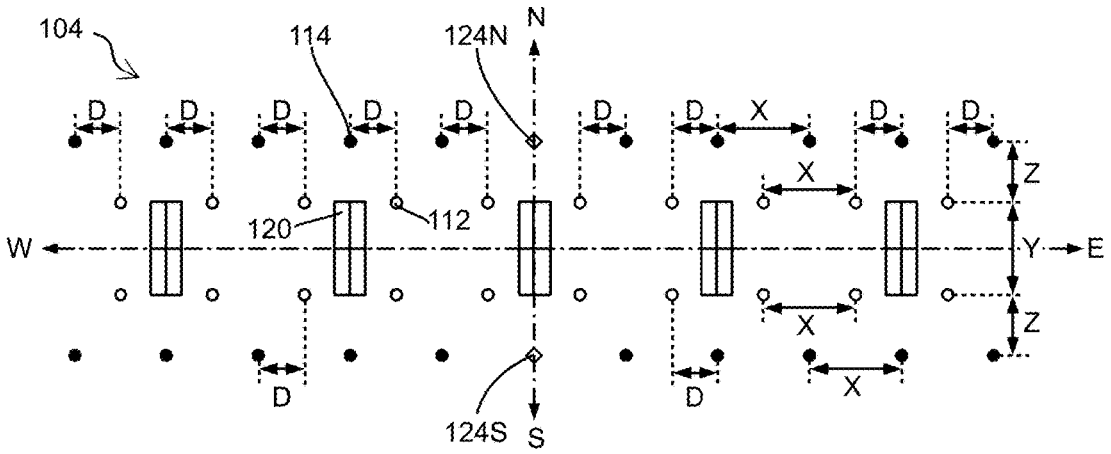
FIG. 5 is a simplified schematic diagram of the portion of the well pad system of FIG. 3A for showing the naming convention.

FIG. 5 shows the naming convention of the well pad 104. As shown, the injection wellheads 112 in each injection row 110 are equally spaced with a spacing distance X. The production wellheads 114 in each production row 108 are also equally spaced with the same spacing distance X. The distance between the two injection rows 110 is denoted as Y. In other words, the distance between any of the two injection rows 110 and the W-E axis is Y/2. The distance between the neighboring injection and production rows 110 and 108 on the NORTH (or SOUTH) side of the W-E axis is denoted as Z. The width along the W-E axis between a production wellhead 114 and it S-N axis side neighboring injection wellhead 112 is denoted as D. Then, a well pad 104 may be denoted as X×Y×Z×D. For example, the well pad 104 of FIGS. 3A to 3N may be denoted as 12×12×8×6, with each number being in meters.

A designer may choose the value of X, Y, Z and D depending on the machinery access requirement on the surface and the subsurface anti-collision requirement. As is known in the art, in SAGD, the subsurface wellbores of the production and injection well pairs must be offset by a minimum distance to avoid the so-called collision.

The distances X, Y, Z and D are positive numbers and may take a wide range of values. For example, in some embodiments, X may be about 6 m to about 30 m, inclusive; Y may be about 6 m to about 30 m, inclusive; Z may be about 2 m to about 30 m, inclusive; and D may be about 1 m to about 20 m, inclusive.

In some other embodiments, X may be about 6 m to about 24 m, inclusive; Y may be about 6 m to about 24 m, inclusive; Z may be about 6 m to about 24 m, inclusive; and D may be about 1 m to about 15 m, inclusive.

In some embodiments, X, Y, Z and D preferably take integer values. However, in some other embodiments, at least some of X, Y, Z and D may take non-integer values. Generally, X, Y, Z and D may take any suitable values with above described ranges, and may be combined in any suitable ways within physical constraints including wellhead, drilling, access, and wellbore path design.

In an alternative embodiment, the width along the W-E axis between a production wellhead 114 and it neighboring injection wellhead 112 on the side of the production wellhead 114 opposite to the S-N axis may be denoted as D.

In embodiments with advanced directional drilling technologies, e.g., directional drilling using magnetometers and accelerometers, e.g., magnetic ranging, subsurface wellbore pairs can be precisely drilled and arranged in a dense manner without subsurface wellbore collision.

In one embodiment, a Z=8 m separation between production and injection rows 110 and 108 may be used. Simulation and evaluation have found that it is feasible at the shallowest depth of 230 m TVD for vertical drilling. With this 8 m production/injection row spacing, wells have to be carefully planned and drilled. For example, to avoid subsurface collisions required for safe drilling to the Intermediate Casing shoe, one wellhead in the center of each production row 108, i.e., at the future well location 124N, 124S, is left blank. The spacing around this 'blank site' will accommodate a drilling rig at a later date for replacement well purposes. These wells are often called re-drills.

Figure 6A:
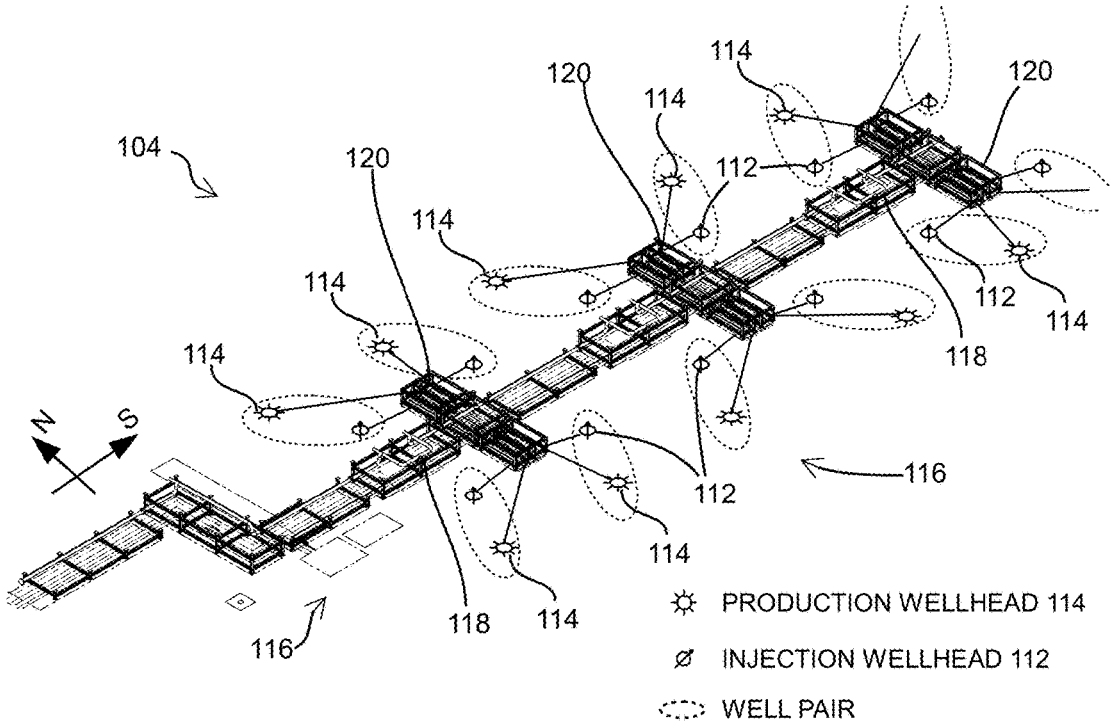
FIG. 6A is a perspective view of a portion of a well pad of the pad system of FIG. 2, according to an alternative embodiment.
Figure 6B:
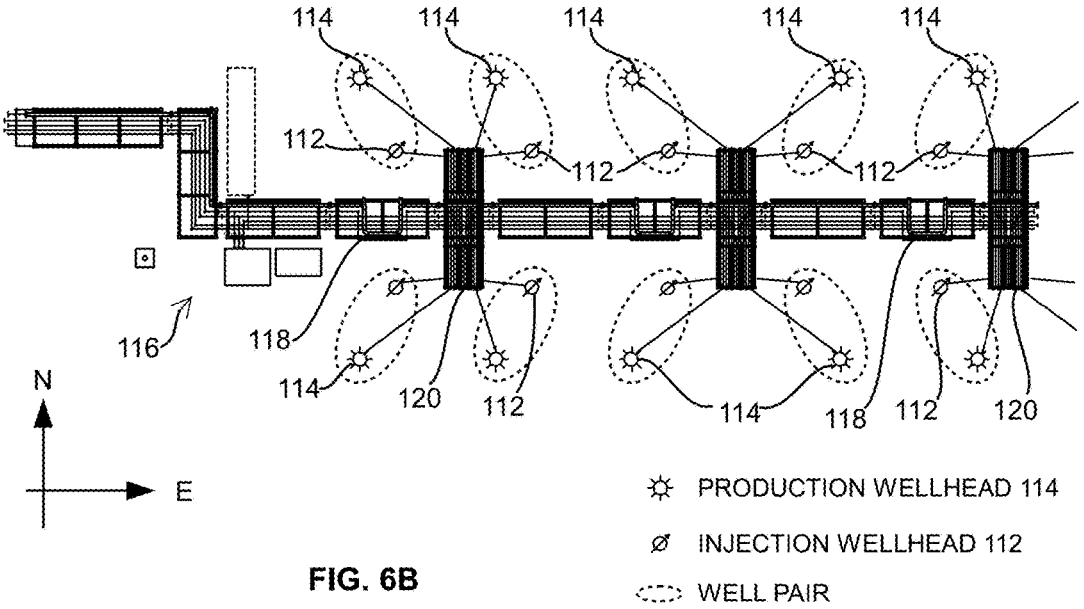
FIG. 6B is a plan view of the portion of the well pad of FIG. 6A.
Figure 6C:
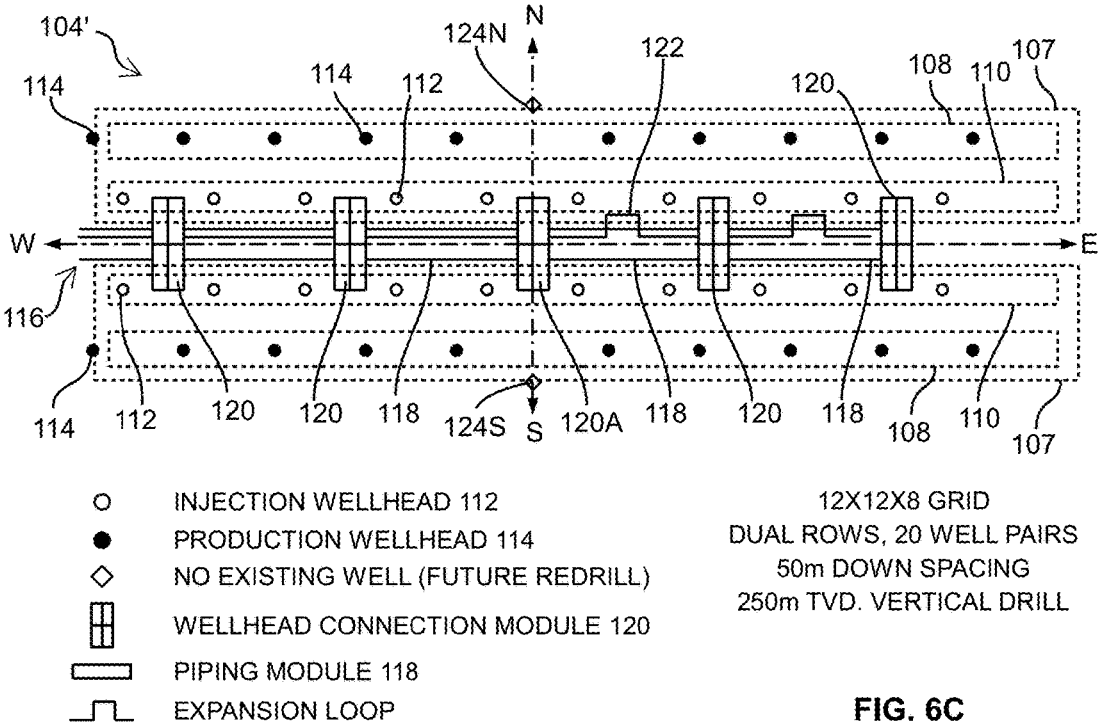
FIG. 6C is a schematic diagram of the portion of the well pad of FIG. 6A, showing some dimensions and measurements of the well pad system.
Figure 6D:
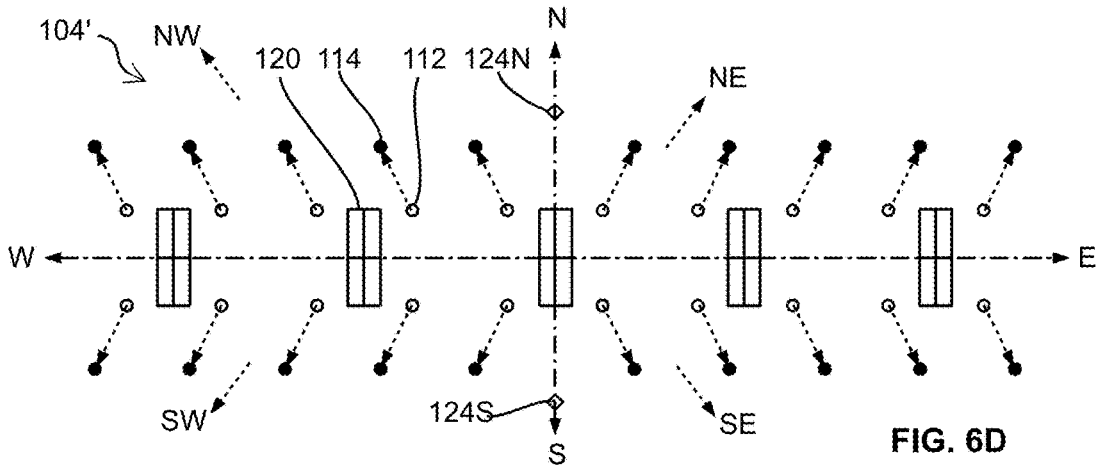
FIG. 6D is a simplified schematic diagram of the portion of the well pad of FIG. 6A for illustrating well pair vectors.
Figure 6E:
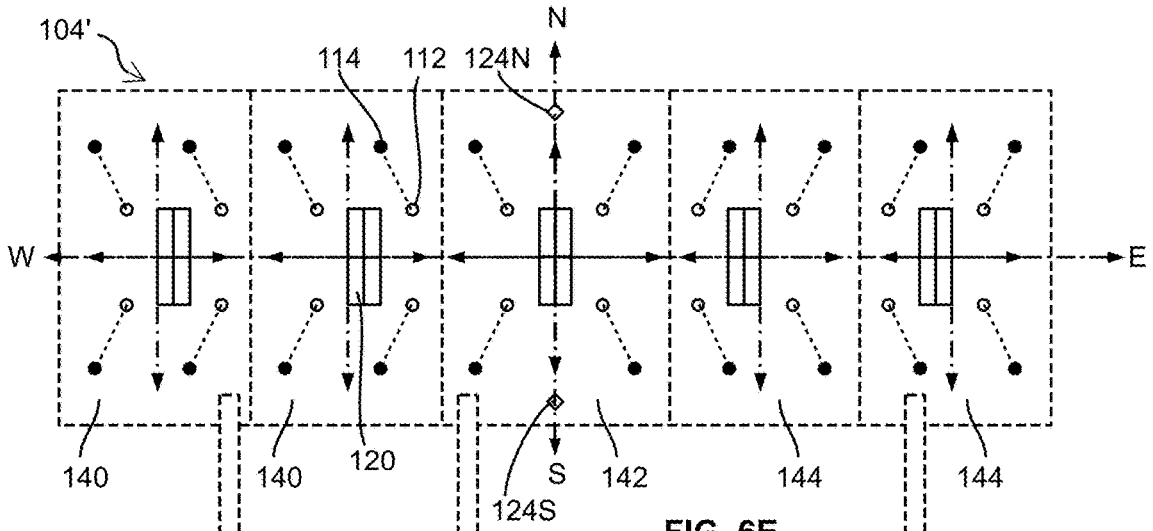
FIGS. 6E to 6H are simplified schematic diagrams of the portion of the well pad of FIG. 6A, for illustrating the relationship between wellhead connection modules and well pairs.
Figure 6F:
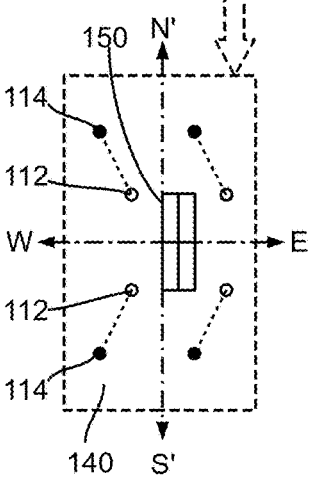
Figure 6G:
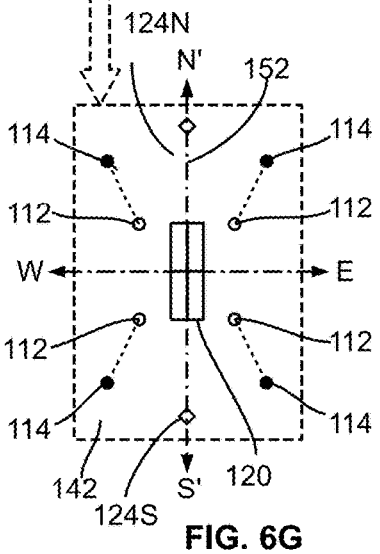
Figure 6H:
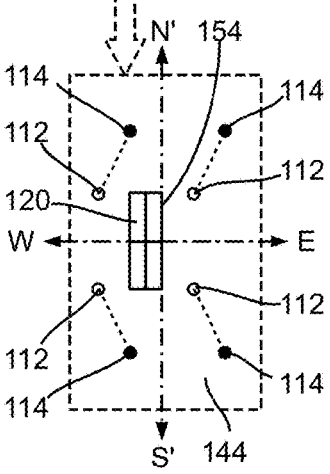
Figure 6I:
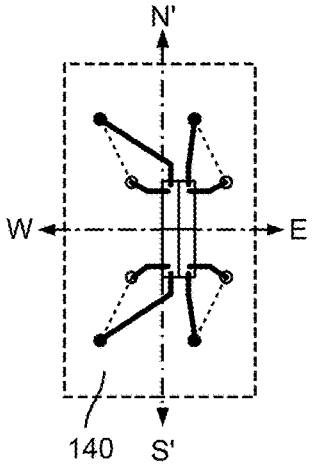
FIGS. 6I to 6K are simplified schematic diagrams of the portion of the well pad of FIG. 6A, for illustrating the connections between wellhead connection modules and well pairs.
Figure 6J:
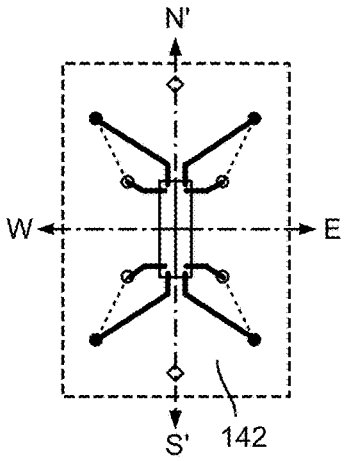
Figure 6K:
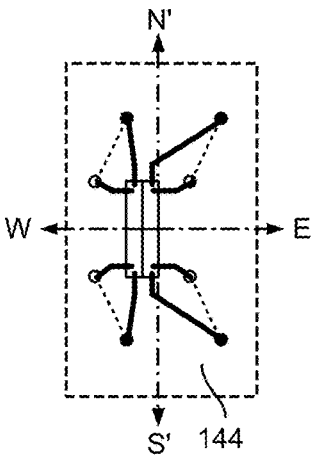
Figure 6L:
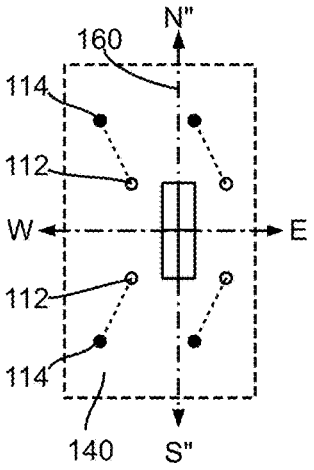
FIGS. 6L to 6N are alternative simplified schematic diagrams of the portion of the well pad of FIG. 6A, for illustrating the relationship between wellhead connection modules and well pairs.
Figure 6M:
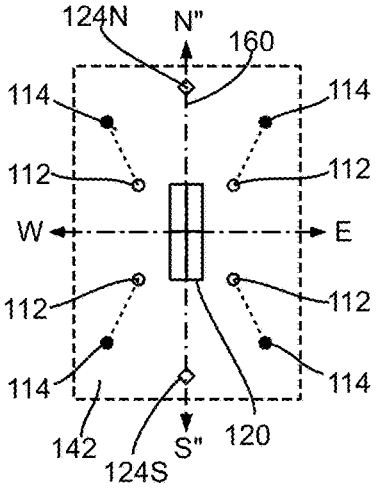
Figure 6N:
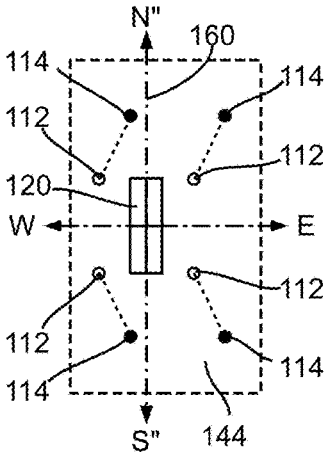
Figure 6O:
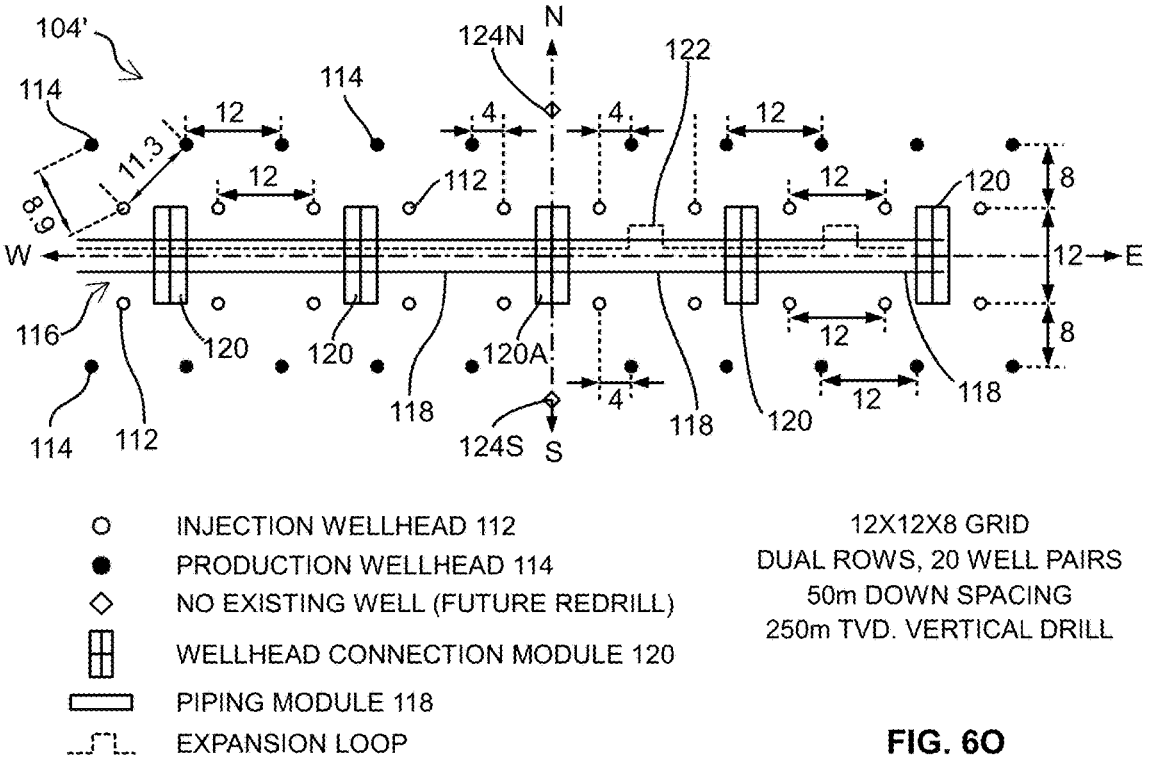
FIGS. 6O and 6P are simplified schematic diagrams of the portion of the well pad system of FIG. 6A, showing some dimensions and measurements of the well pad system.
Figure 6P:
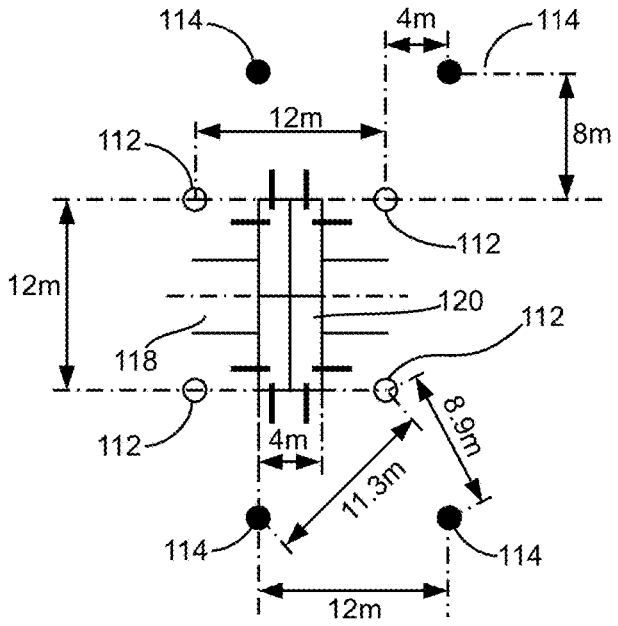

FIGS. 6A to 6P show the structure of a well pad 104' having a 12×12×8×4 structure, according to an alternative embodiment. As can be seen, the well pad 104 differs from the well pad 104 of FIGS. 3A to 3N only in that, all production wellheads 114 are slightly "offset" towards the S-N axis. As a consequence, in this embodiment, no production wellhead 114 is along the longitudinal axis S"-N" of the wellhead connection module 120 (see FIGS. 6L to 6N). Each injection wellhead 112 in the NW and SW quadrants is about 8.9 m to the neighboring production wellhead 114 on its left-hand side and about 11.3 m to the neighboring production wellhead 114 on its right-hand side (see FIGS. 6O and 6P). The wellheads in the NE and SE quadrants are mirrored to those in the NW and SW quadrants. Also, the optional future well locations 124N and 124S are offset away from the W-E axis and the production row 108 as the distance between the two production wellheads 114 on the NORTH (or SOUTH) side of the W-E axis becomes shorter compared to that in the embodiment of FIGS. 3A to 3N. In this embodiment, the production wellheads 114 form two outer rows 108, and the injection wellheads 112 form two inner rows 110. The injection wellheads 112 are positioned in an offset manner with respect to the production wellheads 114 such that each injection wellhead 112 has two neighboring production wellheads 114 on the left and right hand sides thereof, respectively. Therefore, each injection wellhead 112 (except the two injection wellheads 112 closest to the S-N axis) and its two neighboring production wellheads 114 form an acute-angled triangle, i.e., all internal angles of the so-formed triangle are acute angles, and each production wellhead 114 (except the two production wellheads 114 farthest to the S-N axis) and its two neighboring injection wellheads 112 also form an acute-angled triangle.

As shown in FIG. 6D, each wellhead pair form a well pair vector from the injection wellhead 112 to the production wellhead 114 generally pointing away from the origin of the well pad coordinate system. In particular, each wellhead pair in the NE quadrant form a well pair vector pointing to the North-East; each wellhead pair in the NW quadrant form a well pair vector pointing to the North-West; each wellhead pair in the SE quadrant form a well pair vector pointing to the South-East; and each wellhead pair in the SW quadrant form a well pair vector pointing to the South-West.

As shown in FIG. 6E, the well pad 104 may also be partitioned to a plurality of wellhead-piping sections, comprising one or more left-hand wellhead-piping sections 140 on the WEST side of the S-N axis, a central wellhead-piping section 142 and one or more right-hand wellhead-piping sections 144 on the EAST side of the S-N axis.

As shown in FIGS. 6E to 6H, each section 140, 142, 144 has a section coordinate system formed by the W-E axis and a respective S'-N' axis, i.e., along the left-hand side 150 of the wellhead connection module 120 in sections 140, along the longitudinal axis 152 in section 142, and along the right-hand side 150 of the wellhead connection module 120 in sections 144. In each section 140, 142, 144, each section quadrant of the section coordinate system comprises a pair of wellheads 112 and 114.

FIGS. 6I to 6K show the connections between wellhead pairs 112/114 and the wellhead connection module 120 in sections 140, 142 and 144, respectively. As shown, in each of sections 140, 142 and 144, each wellhead pair 112/114 is connected adjacent a corner of the wellhead connection module 120 via suitable piping.

FIGS. 6L to 6N show an alternative characterization of the sections 140, 142 and 144 in this embodiment. Each wellhead connection module 120 has a longitudinal axis 160 defining an S"-N" axis orthogonal to the W-E axis. The S"-N" axis and the W-E axis then form a section coordinate system with four quadrants. Each section quadrant comprises a well pair 112/114.

Other well pad surface structures are also readily available. For example, in an alternative embodiment, the well pad 104 may have a 15×15×8×4 structure. Other well pad structure examples in various embodiments include 6×6×6×1, 18×18×18×4, 18×15×18×4, and 24×24×24×12.

In embodiment of FIGS. 3A to 3N and embodiment of FIGS. 6A to 6N, the well pads 104 and 104' each has 20 well pairs. In some alternative embodiments, a well pad may take a different number of well pairs, e.g., 24 well pairs, or 36 well pairs.

In above embodiments, the well pairs are symmetrically distributed in the four well pad quadrants with each quadrant having a same number of well pairs. In some alternative embodiments, some well pad quadrant(s) may have different number of well pairs than other quadrants. For example, in one embodiment, the NE and SE well pad quadrants may each have three well pairs, and the NW and SW quadrants may each have five well pairs, giving rise to 16 well pairs in total.

Figure 7:
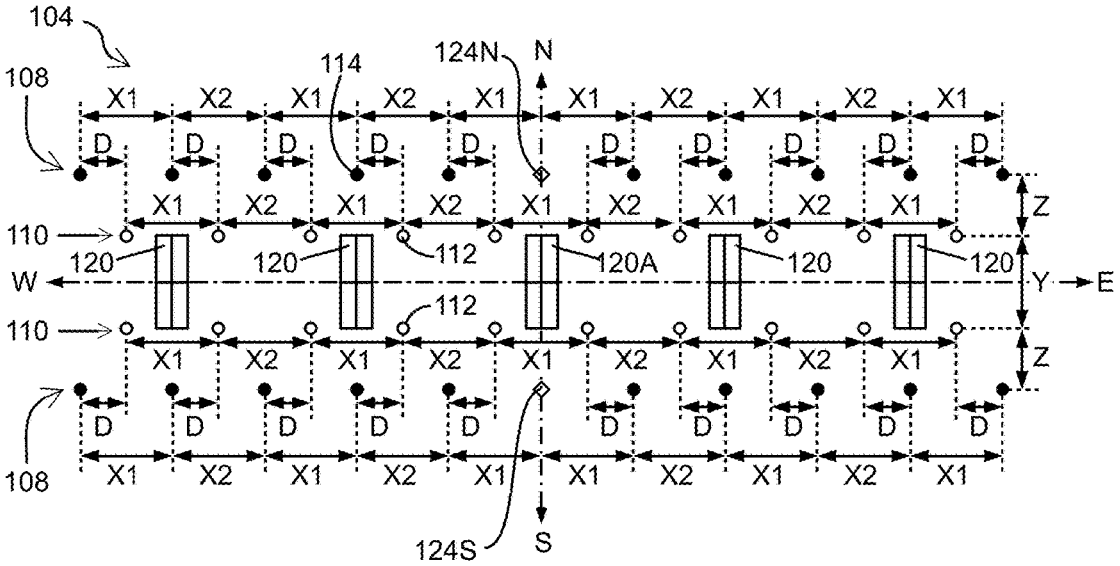
FIG. 7 is a simplified schematic diagram of the portion of the well pad system of FIG. 2 for showing the naming convention, according to one embodiment.

As shown in FIG. 7, in some embodiments, the injection wellheads 112 in each injection row have alternate spacing arrangement. In each injection row, each pair of adjacent injection wellheads 112 connected to the same wellhead connection module 120 are spaced by a first distance X1, and each pair of adjacent injection wellheads 112 connected to different wellhead connection modules 120 are spaced by a second distance X2. Correspondingly, in each production row, each pair of adjacent production wellheads 112 connected to the same wellhead connection module 120 are spaced by a first distance X1, and each pair of adjacent production wellheads 112 connected to different wellhead connection modules 120 are spaced by a second distance X2 (except the two production wellheads 114 connected to the central wellhead connection module 120A, the distance between which is twice of X2). Such a well pad structure may be denoted as (X1/X2)×Y×Z×D. Either of X1 and X2 may be a value within the ranges of X described above.

In some embodiments, X2 may be smaller than X1, giving rise to denser wellhead arrangement. In some other embodiments, X2 may be greater than X1. Of course, X2 may be equal to X1, in which case it becomes the embodiments of FIGS. 3A to 3N and FIGS. 5A to 5N. Therefore, the well pad structure notation X×Y×Z×D may be considered as a short notation of (X/X)×Y×Z×D.

For example, in one embodiment, the well pad may have a (15/12)×15×15×7.5 structure, with each of the wellhead connection modules 120 having a dimension of about 5 m by about 15 m.

In an alternative embodiment, the well pad may have a (15/12)×15×12×7.5 structure, with each of the wellhead connection modules 120 having a dimension of about 5 m by about 15 m.

In an alternative embodiment, the well pad may have a (16/12)×16×12×8 structure, with each of the wellhead connection modules 120 having a dimension of a width of about 5 m by a length of about 16 m.

Figure 8:
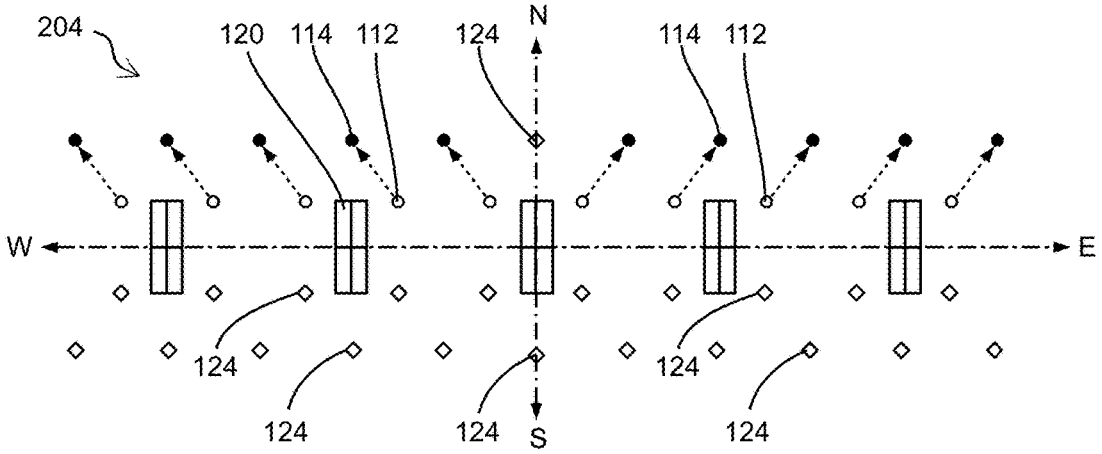
FIGS. 8 to 12B are simplified schematic diagrams of the portion of the well pad of the pad system of FIG. 2, according to various alternative embodiments.

With reference to FIG. 8, in some embodiments, the well pairs are deployed in such a way as if one, two or three well pad quadrants have no well pairs. For example, as shown, a well pad 204 only comprises 10 well pairs 112/114 symmetrically distributed with respect to an S-N axis on the NORTH side of the W-E axis. The W-E axis is defined in a similar manner as above.

Each of the five (5) well pairs on the WEST side of the S-N axis has a well pair vector pointing to the North-West, and each of the five (5) well pairs on the EAST side of the S-N axis has a well pair vector pointing to the North-East. No well pairs are distributed on the SOUTH side of the W-E axis. The SOUTH side of the W-E axis is not used, or alternatively, reserved for drilling future wells 124 at a later time.

Figure 9A:
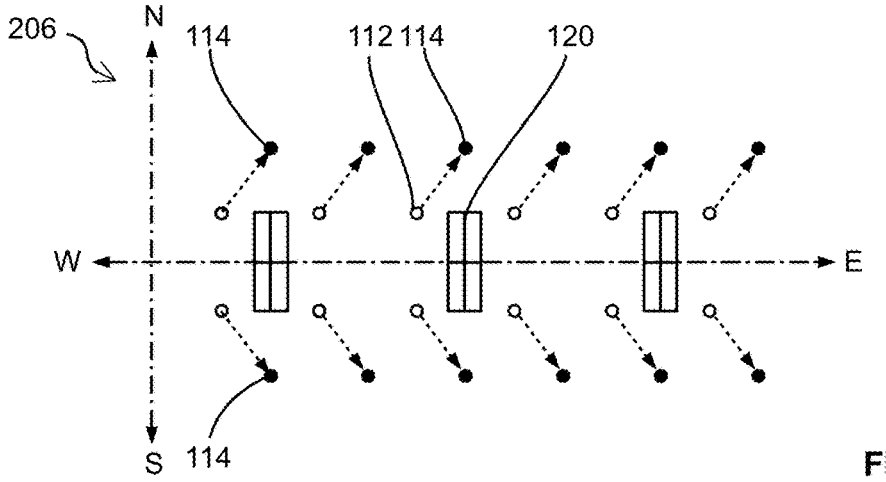

As shown in FIG. 9A, in another embodiment, a well pad 206 has 12 well pairs 112/114 symmetrically distributed on both sides of the W-E axis. In this embodiment, an injection wellhead 112 on the NORTH side of the W-E axis is paired with a neighboring production wellhead 114 at its North-East direction. An injection wellhead 112 on the SOUTH side of the W-E axis are paired with a neighboring production wellhead 114 at its South-East direction. Thus, each of the six (6) well pairs on the NORTH side of the W-E axis has a well pair vector pointing to the North-East, and each of the six (6) well pairs on the SOUTH side of the W-E axis has a well pair vector pointing to the South-East.

Figure 9B:
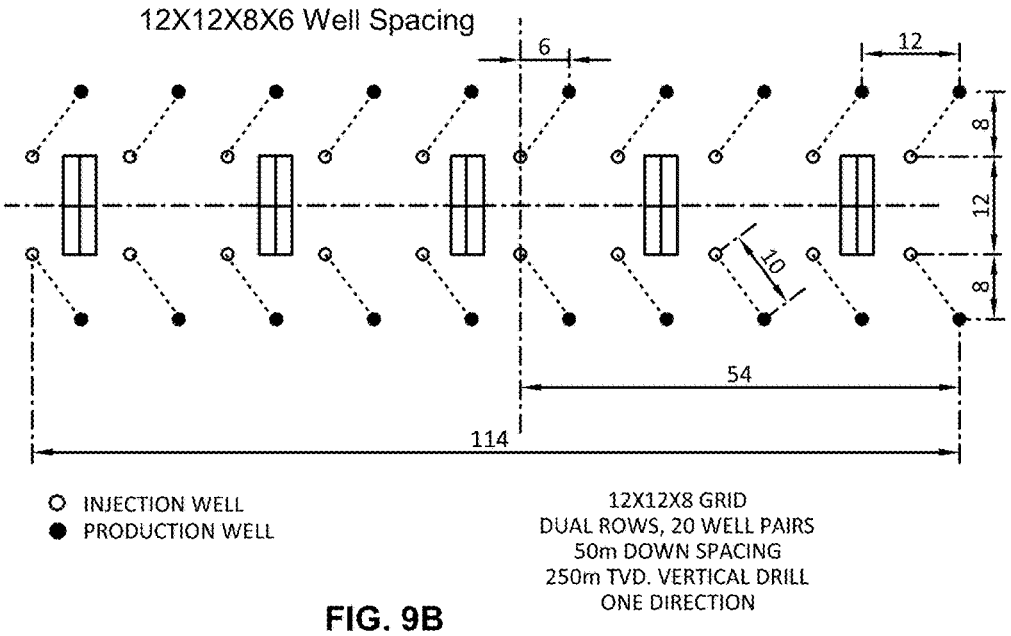

FIG. 9B shows a well pad having 20 well pairs with a wellhead arrangement similar to that of FIG. 9A. Compared to the well pad of FIG. 4A, the wellhead span of FIG. 9B is 114 m, reduced from the 120 m wellhead span of FIG. 4A. However, advanced drilling technologies may be required to avoid subsurface well collision.

In an alternative embodiment, an injection wellhead on the NORTH side of the W-E axis is paired with a neighboring production wellhead at its North-West direction. An injection wellhead on the SOUTH side of the W-E axis is paired with a neighboring production wellhead at its South-West direction.

Figure 10:
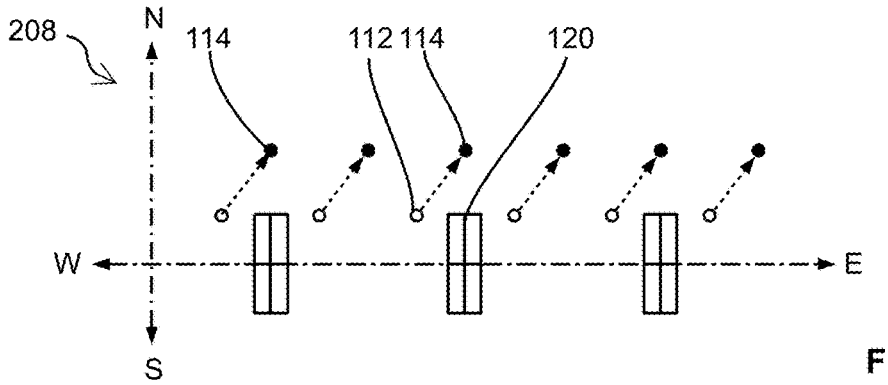

As another example, in one embodiment as shown in FIG. 10, a well pad 208 only comprises six (6) well pairs all distributed on the NORTH side of the W-E axis. Each of the six (6) well pairs has a well pair vector pointing to the North-East.

Figure 11A:
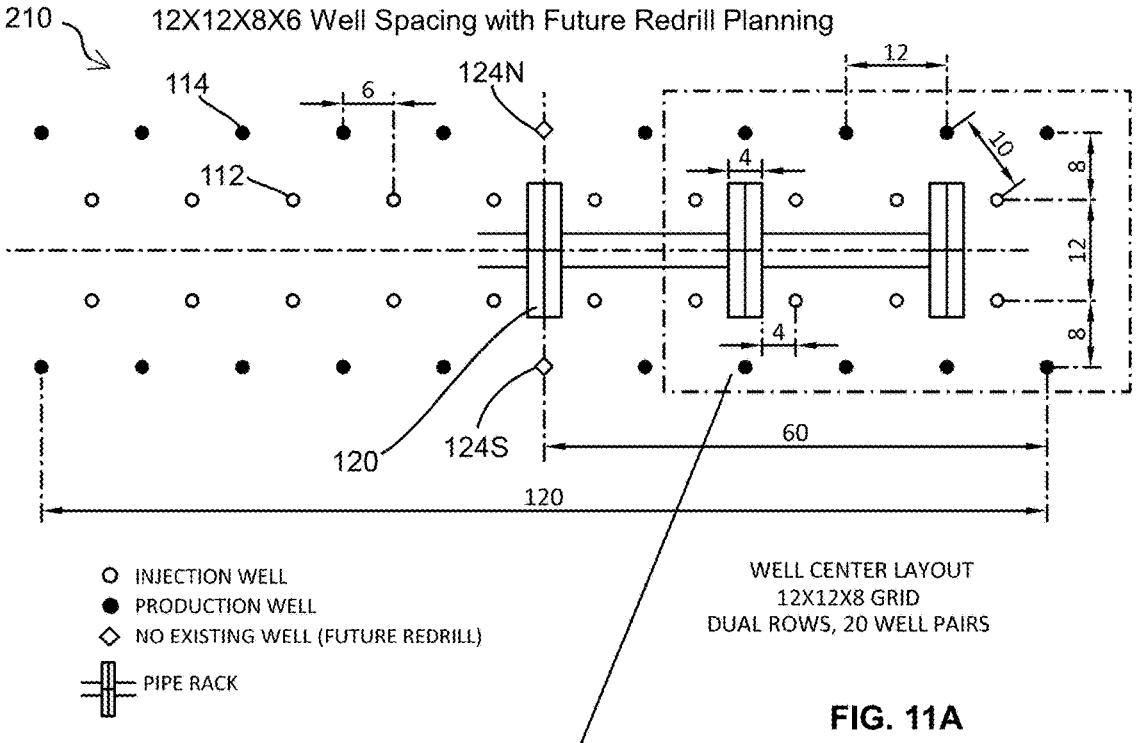
Figure 11B:
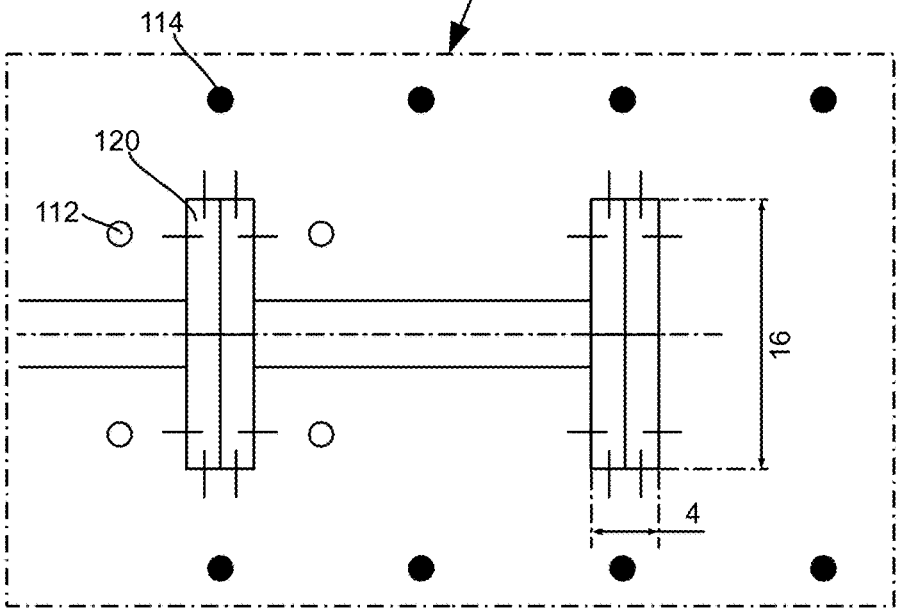

More alternative embodiments are readily available. For example, the well pad 210 of FIGS. 11A and 11B has 20 well pairs with a 12×12×12×6 structure. In this embodiment, each of the wellhead connection modules 120 has a larger dimension of a width of about 4 m by a length of about 16 m.

In an alternative embodiment, the well pad may have a 16×16×16×8 structure, with each of the wellhead connection modules 120 having a dimension of a width of about 5 m by a length of about 16 m.

In an alternative embodiment, the well pad may have a 15×15×15×7.5 structure, with each of the wellhead connection modules 120 having a dimension of a width of about 5 m by a length of about 15 m.

Figure 12A:
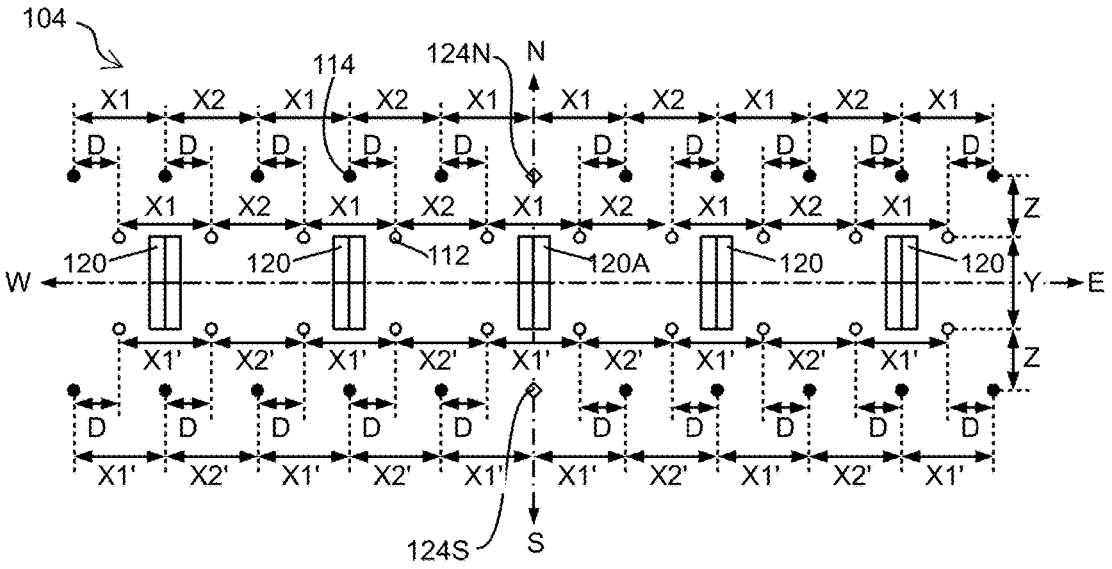

FIG. 12A shows a well pad 212 according to some embodiments. As shown, the injection and production wellheads 112 and 114 on the NORTH side of the W-E axis may have a first X1 and X2, and those on the SOUTH side of the W-E axis may have a second X1 and X2, denoted as X1' and X2', different than X1 and X2. In other words, the well pad on the NORTH side of the W-E axis has a first structure (X1/X2)×Y×Z×D, but the well pad on the SOUTH side of the W-E axis has a different, second structure (X1'/X2')×Y×Z×D.

In some other embodiments, the well pad on the NORTH side of the W-E axis has a first structure (X1/X2)×Y×Z×D, but the well pad on the SOUTH side of the W-E axis has a second structure (X1'/X2')×Y'×Z'×D'. At least some values of X1, X2, Y, Z and D are different than the respective values of X1', X2', Y', Z' and D'.

In yet some other embodiments, each well pad quadrant may have its own X1, X2, Y, Z and D values, being the same as or different than the X1, X2, Y, Z and D values of other quadrants, as the system designer sees fit.

Figure 12B:
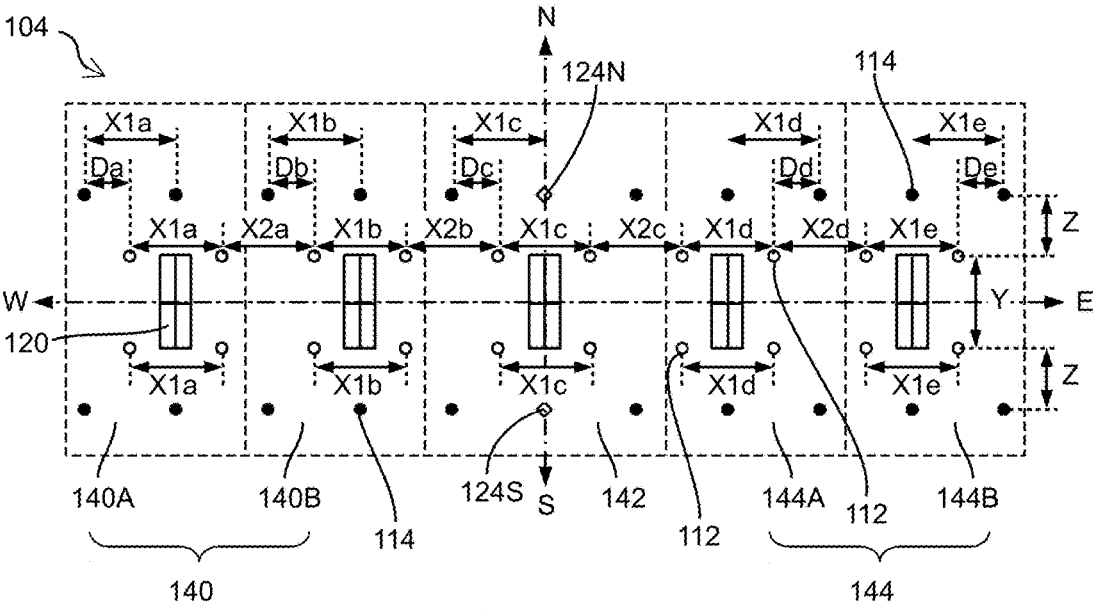

Referring to FIGS. 3E, 6E and 12B, in some alternative embodiments, each one of sections 140, 142 and 144 may have its own X1, Y, Z and D values, and each two adjacent sections, such as adjacent sections 140 and 140, adjacent sections 140 and 142, adjacent sections 142 and 144, and adjacent sections 144 and 144, has a separate distance X2. For example, in FIG. 12B, section 140A has its own X1, D values, denoted as X1 a, and Da, section 140B has its own X1, D values, denoted as X1 b, and Db, section 142 has its own X1, D values, denoted as X1 c, and Dc, section 144A has its own X1, D values, denoted as X1 d, and Dd, section 144B has its own X1, D values, denoted as X1 e, and De. All sections 140A, 140B, 142, 144A and 144B have the same Y and Z. The spacing between sections 140A and 140B is X2a, between sections 140B and 142 is X2b, between sections 142 and 144A is X2c, between sections 144A and 144B is X2d. These values may be different or the same depending on the system design.

In some other embodiments, all sections 140 have a common first set of X1, X2, Y, Z and D values, section 142 has a second set of X1, X2, Y, Z and D values, and all sections 144 have a common third set of X1, X2, Y, Z and D values. The first, second and third sets of X, Y, Z and D values may be different or the same depending on the system design.

Those skilled in the art appreciate that the wellheads described above may be more generally denoted as inner wellheads for the two inner rows 110 closer to the W-E axis, and outer wellheads or wells for the two outer rows 108 farther to the W-E axis. Although in above embodiments, the inner rows 110 are injection wells and the outer rows 108 are production wells, in an alternative embodiment, the inner rows 110 may be production wells and the outer rows 108 may be injection wells. In some other embodiments, a designer may have the freedom to choose which wells shall be injection wells, which wells shall be production wells and how the injection and production wells are paired, based on the system design target and restrictions.

Wellhead Connection Module

In some embodiments, the wellhead connection module 120 has a width (along the W-E axis) between about 2 m and about 6 m, inclusive, and a length (along the S-N axis) between about 6 m and about 24 m, inclusive. In some other embodiments, the wellhead connection module 120 may have other dimensions. The spacing between each wellhead connection module 120 and its neighboring injection wellhead 112 is between about 2 m to 12 m, inclusive.

On the other hand, the piping module 118 may have a suitable width (along the S-N axis), and a length suitable for connecting two adjacent wellhead connection module 120. For example, in some embodiments, the piping module 118 has a width between about 3 m to 6 m, inclusive, and a length between 8 m to 24 m.

In some embodiments, each wellhead connection module 120 is an integrated module. In some alternative embodiments, at least some of the wellhead connection modules 120 are assembled from a plurality of submodules.

Figure 13A:
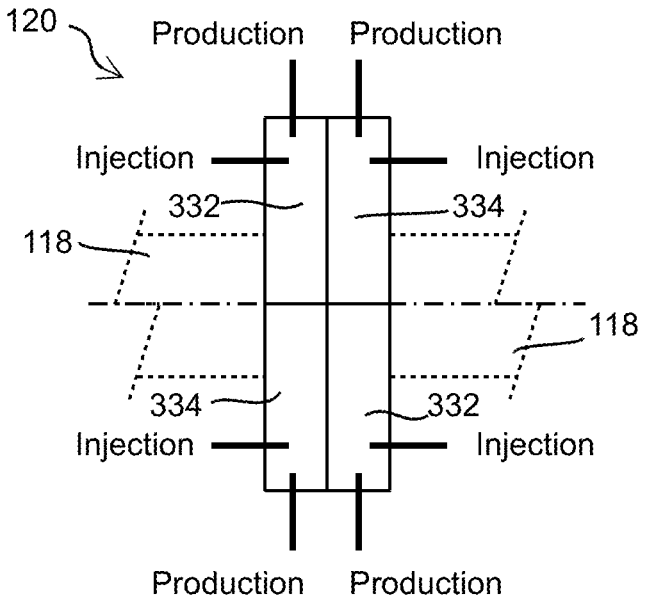
FIG. 13A is a simplified plan view of a wellhead connection module having two left-hand submodules and two right-hand wellhead connection submodules, according to one embodiment.

For example, FIG. 13A shows a schematic diagram of a wellhead connection module 120 having a rectangular shape, and four (4) wellhead connection submodules, including two (2) "left-hand" submodules 332 and two (2) "right-hand" submodules 334. Each wellhead connection submodule 332, 334 is coupled to the wellheads 112 and 114 of a well pair.

In some embodiments, the wellhead connection submodule 332 or 334 has a height between about 1 m and about 2.5 m, inclusive, being cognizant of road allowance.

Figure 13B:
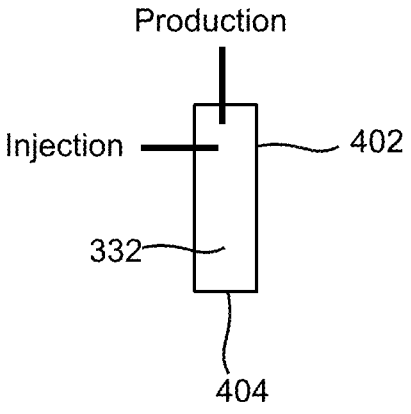
FIGS. 13B and 13C are simplified plan views of the left-hand and right-hand wellhead connection submodules of FIG. 13A, respectively.
Figure 13C:
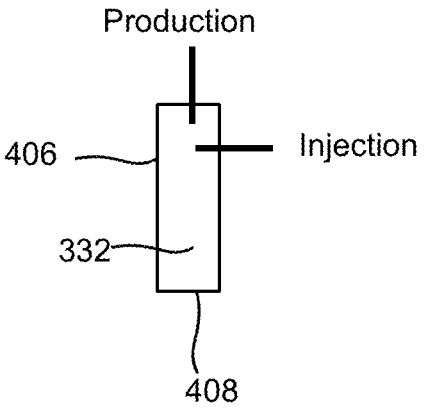

As shown in FIG. 13B, the left-hand wellhead connection submodule 332 has a rectangular shape with a right-hand side 402 for coupling to a right-hand submodule 334, and a rear side 404 for coupling to a right-hand submodule 334. Similarly, as shown in FIG. 13C, the right-hand wellhead connection submodule 334 has a rectangular shape with a left-hand side 406 for coupling to a left-hand submodule 332, and a rear side 408 for coupling to a left-hand submodule 332.

Figure 13D:
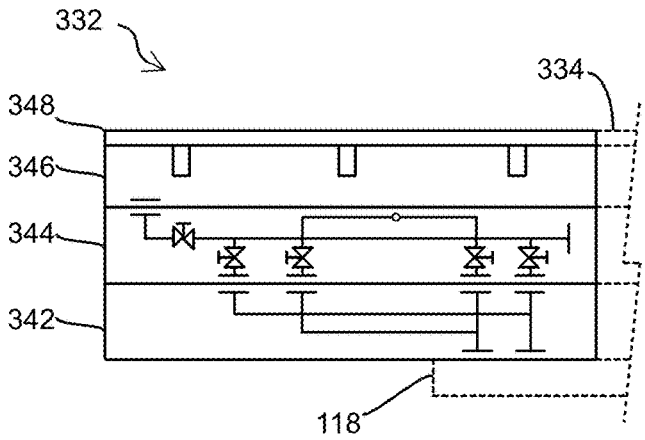
FIGS. 13D and 13E are simplified side and rear views of the left-hand wellhead connection submodule of FIG. 13A, respectively.
Figure 13E:
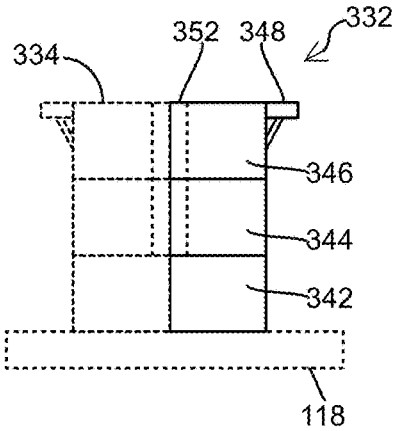

FIGS. 13D and 13E are simplified side and front views, respectively, of the wellhead connection submodule 332 (a left-hand submodule), showing the structure thereof. The submodule 334 has a similar structure but with a mirrored layout (a right-hand submodule), and thus the following description of submodule 332 is also applicable to submodule 334 other than its handedness. The mirroring enables minimizing of loss of submodule real-estate for mandatory minimum equipment access zones, wherein like sides of adjacent modules 332,334 each share 0.5 m, 0.5 m of a 1 m requirement.

Figure 13F:
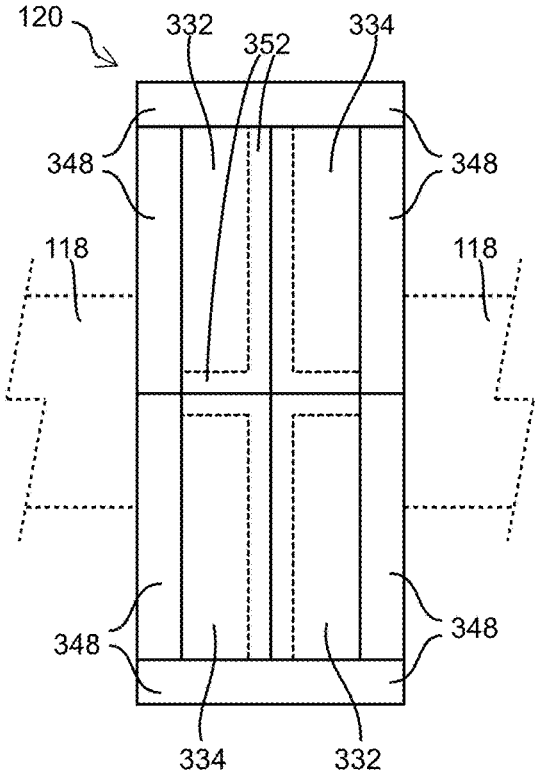
FIG. 13F is a simplified top view of the wellhead connection module of FIG. 13A.

As shown in FIGS. 13D to 13F, the wellhead connection submodule 332 (read 332 or 334) comprises three (3) layers 342 to 346. Each layer has a height of about 2.5 m, and may be manufactured separately and stacked on top of each other. In some alternative embodiments, each layer may have a height between about 1 m (one meter) and about 3 m (three meters), inclusive.

The bottom, header layer 342 comprises one or more necessary headers for coupling to one or more pipes of the piping module 118. The middle, control layer 344 comprises one or more standard valves connecting to the headers in the bottom layer 342. The top, equipment layer comprises additional or optional equipment connecting to the valves in the middle layer 344. In this embodiment, the top layer 346 is customizable or even optional, and is configured or needed only when required, such as to accommodate client requirements for additional artificial lift consideration, and may be in an N-S length different to that of the middle and bottom layers 344 and 342. In another embodiment, the middle layer can include ESP lift. The third layer 346 has components having oil and/or gas lifting and recovery equipment for optional lift and recovery scenarios. Various equipment modules may be bolted on for start-up, late-life, and artificial lift. The wellheads 112/114 are usually connected to the valves in the middle layer 344. However, in some embodiments in which the third layer 346 is used, the wellhead 112 and 114 may alternatively be connected to the third layer 346.

In the middle and top layers 344 and 346, equipment and piping are arranged such that two sides 352 are left clear of 0.5 m to have a combined (0.5 m+0.5 m) equipment access walkways 352 of about 1 m wide at the center of the wellhead connection module 120, when combining with other submodules 332 and 334 to form the wellhead connection module 120.

The submodule 332 also comprises two detachable cantilevered walkways 348 each with a width of about 1 m, mounted on the sides of the top layer 346 opposite to the walkways 352. The cantilevered walkways 348 may also be mounted on the middle layer 344 opposite to the walkways 352 if the top layer 346 is not used. As shown in FIG. 13F, when the four submodules 332 and 334 are coupled together, the wellhead connection module 120 then has about 1 m wide walkways on its four sides, and an about combined 1 m wide walkways at the center thereof. As the cantilevered walkways 348 are off the ground at a sufficient height, they allow a compact well pattern designed based on the dimension of the bottom layer 342 and without considering the dimension of the cantilever walkways 348.

Compared to prior art pipe-racks for conventional two-row well pad system, the wellhead connection module 120 is arranged transverse to the piping module, stacked vertically and comprises virtually all necessary valving, and therefore, the piping module 118 can have a smaller width, for example, between about 2 m to 6 m.

Figure 13G:
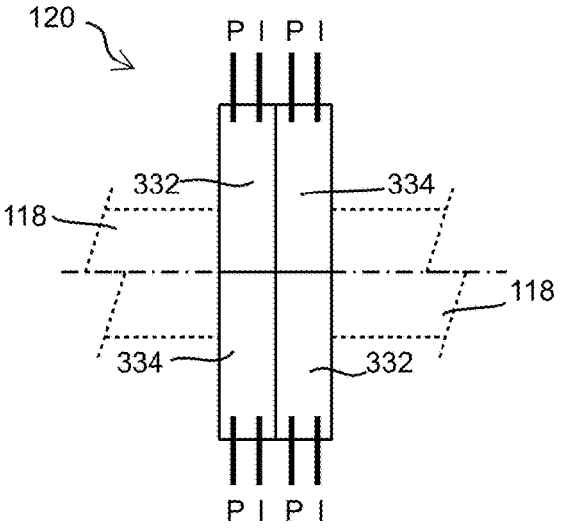
FIG. 13G is a simplified plan views of a wellhead connection module having two left-hand submodules and two right-hand wellhead connection submodules, according to an alternative embodiment.
Figure 13H:
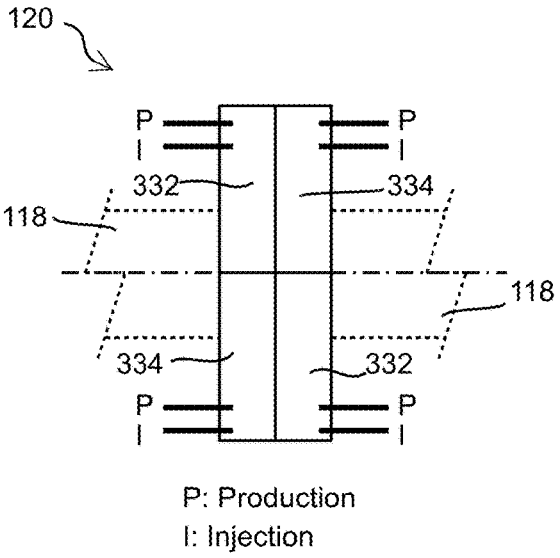
FIG. 13H is a simplified plan views of a wellhead connection module having two left-hand submodules and two right-hand wellhead connection submodules, according to another embodiment.

In FIG. 13A, the connectors of production wells (marked as "Production") are extended from the sides different to the connectors of injection wells (marked as "Injection"). FIGS. 13G and 13H show different connector configurations. In FIG. 13G, connectors of production wells (marked as "P") and connectors of injection wells (marked as "I") are extended from the front and rear sides of the wellhead connection module 120. In FIG. 13H, connectors of production wells and connectors of injection wells are extended from the left-hand and right-hand sides of the wellhead connection module 120.

Figure 14A:
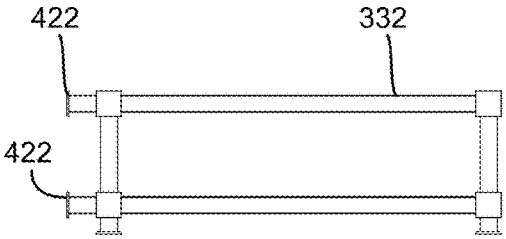
FIGS. 14A to 14C show the side view, plan view and perspective view of the bottom header layer frame of a left-hand submodule of FIG. 13A.
Figure 14B:
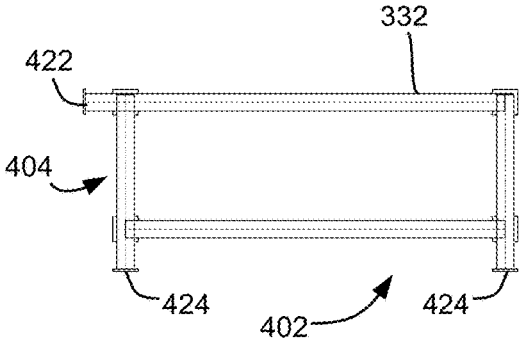
Figure 14C:
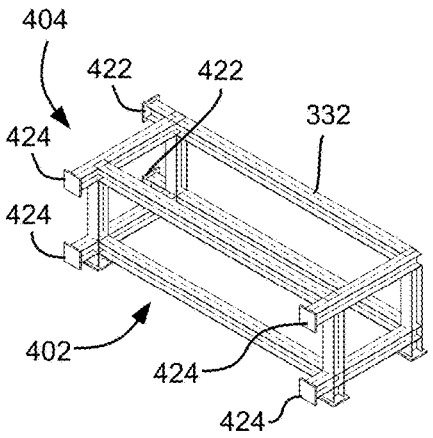

FIGS. 14A to 14C show the side view, plan view and perspective view of the bottom header layer frame of a left-hand submodule 332. As can be seen, the left-hand submodule 332 comprises a set of rear-coupling flanges 422 for coupling to a right-hand submodule 334 at its rear end, and a set of side-coupling flanges 424 for coupling to a right-hand submodule 334 at its right-hand side 402.

Figure 15:
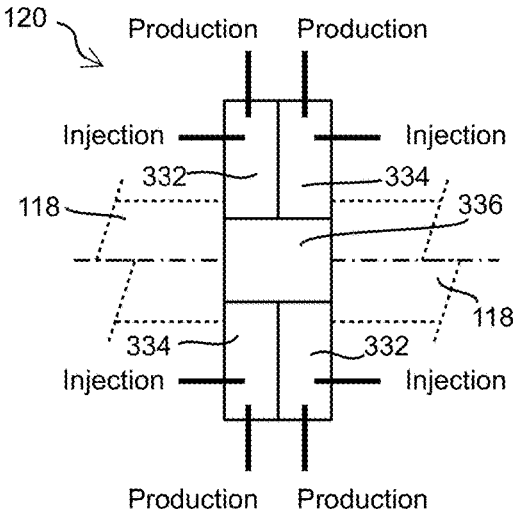
FIG. 15 is a simplified plan view of a wellhead connection module having two left-hand submodules, two right-hand wellhead connection submodules and a connector submodule, according to an alternative embodiment.

FIG. 15 shows a wellhead connection module 120 according to an alternative embodiment. As can be seen, the wellhead connection module 120 is similar to that of FIG. 13A except that, in addition to the submodules 332 and 334, the wellhead connection module 120 in this embodiment further comprises a connector submodule 336 for connecting to the piping modules 118, and accordingly, the submodules 332 and 334 have a smaller size compared to those of FIG. 13A. The connector module 306 may have one, two or three layers in various embodiments for corresponding to the bottom, middle and top layers of the submodules 332 and 334.

As described above, the wellhead connection module 120 may have a length about the same as, or alternatively larger than, the distance between the two injection rows 110. In some alternative embodiments, the wellhead connection module 120 may have a length smaller than the distance between the two injection rows 110.

Figure 16A:
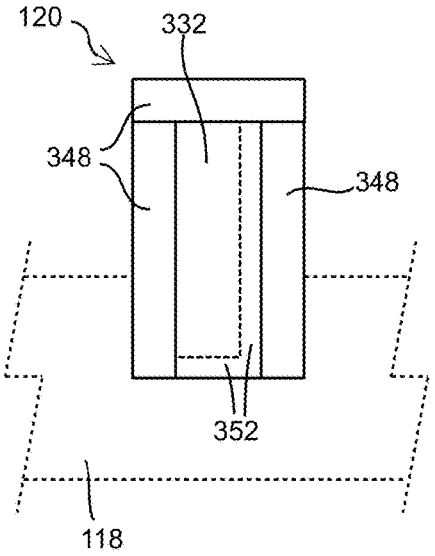
FIGS. 16A and 16B show two examples of a wellhead connection module having one and two submodules, respectively, with detachable cantilevered walkways, according to an alternative embodiment.
Figure 16B:
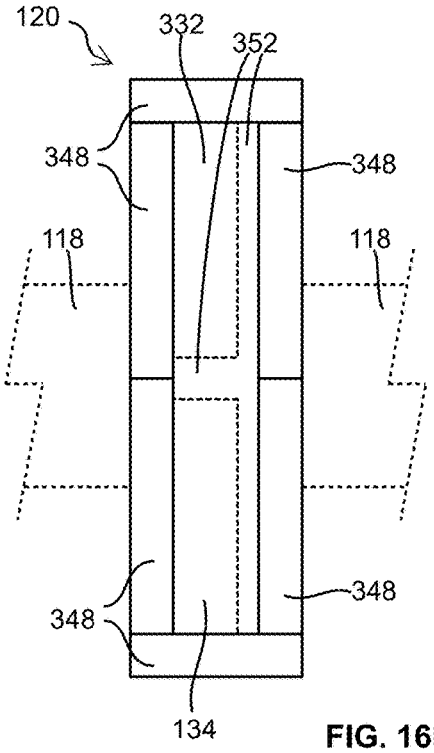
Figure 17A:
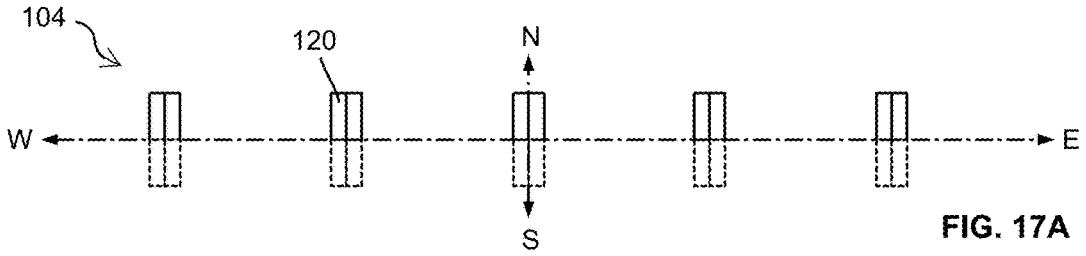
FIGS. 17A to 17E show some examples of a well pad system with each wellhead connection module having two submodules, according to various embodiments.
Figure 17B:
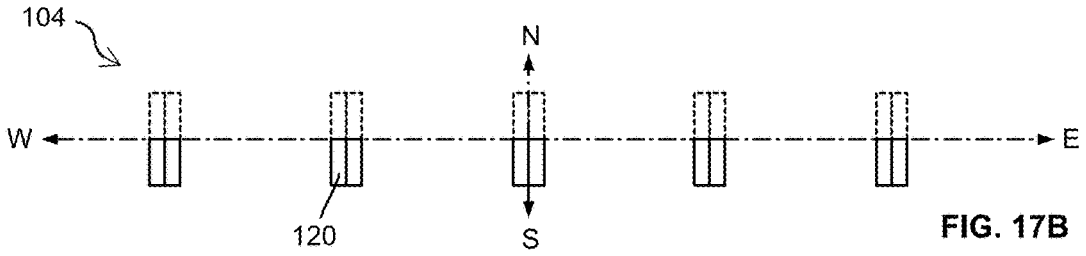
Figure 17C:
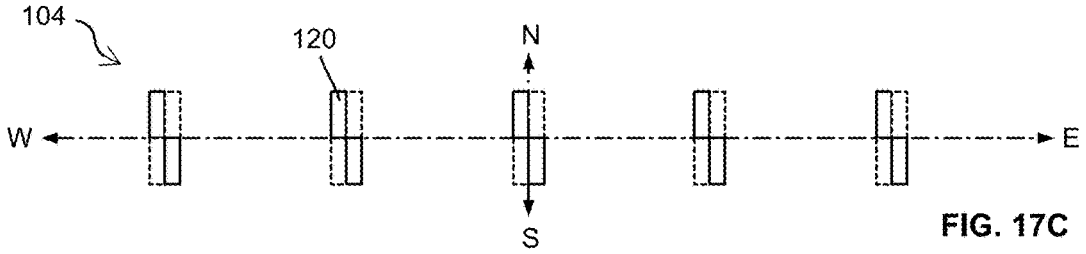
Figure 17D:
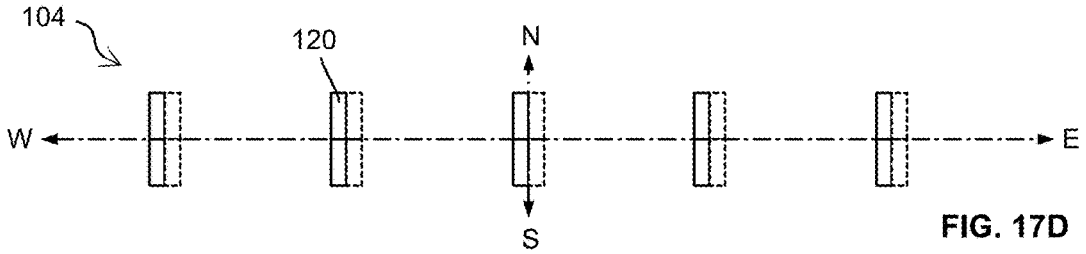
Figure 17E:
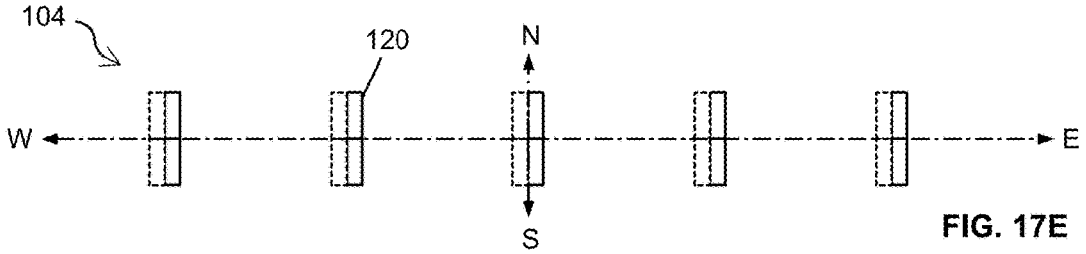

In some embodiments, a wellhead connection module 120 may comprise one (1), two (2) or three (3) submodules 332, 334. In these embodiments, the top or middle layer of the wellhead connection module 120 also has detachable cantilevered walkways, mounted thereon in a manner similar to FIG. 13F. FIGS. 16A and 16B show two examples.

As described before, each wellhead connection module 120 may comprise one, two, three or four submodules. FIGS. 17A to 17E show some examples, wherein solid-line blocks represent submodules. Broken-line blocks are added for comparison with the typical wellhead connection module 120 having four submodules.

In above embodiments, the wellhead connection module 120 and submodules 332 and 334 are of rectangular shapes. In some alternative embodiments, the wellhead connection module 120 and submodules 332 and 334 may have any suitable shapes. Regardless the shapes of the wellhead connection modules 120, each wellhead connection module 120 has a physical or virtual side 150 for defining the S'-N' axis as described above.

In above embodiments, the submodules 332 and 334 have a similar structure but with a mirrored layout. In some alternative embodiments, the submodules 332 and 334 do not have a mirrored layout. Rather, the submodules 332 and 334 may have the same layout, or alternatively, different layouts, but are still capable of side-assembling and/or rear-assembling to other submodules as described above.

According to one aspect of this disclosure, submodules 332 and 334, wellhead connection modules 120, piping modules 108 and the entire well pad 104 are designed with standardized drawings. For example, each drawing of wellhead connection module is designed to be a modularized drawing to allow for expedited engineering, modelling, and collaborative reviews. Therefore, the 3D modelling of a well pad 104 may be completed in 200 hours comparing to conventional well pad 3D modeling that would require 2000 hours of modelling time.

Well Pad Subsurface Structure

Figure 18:
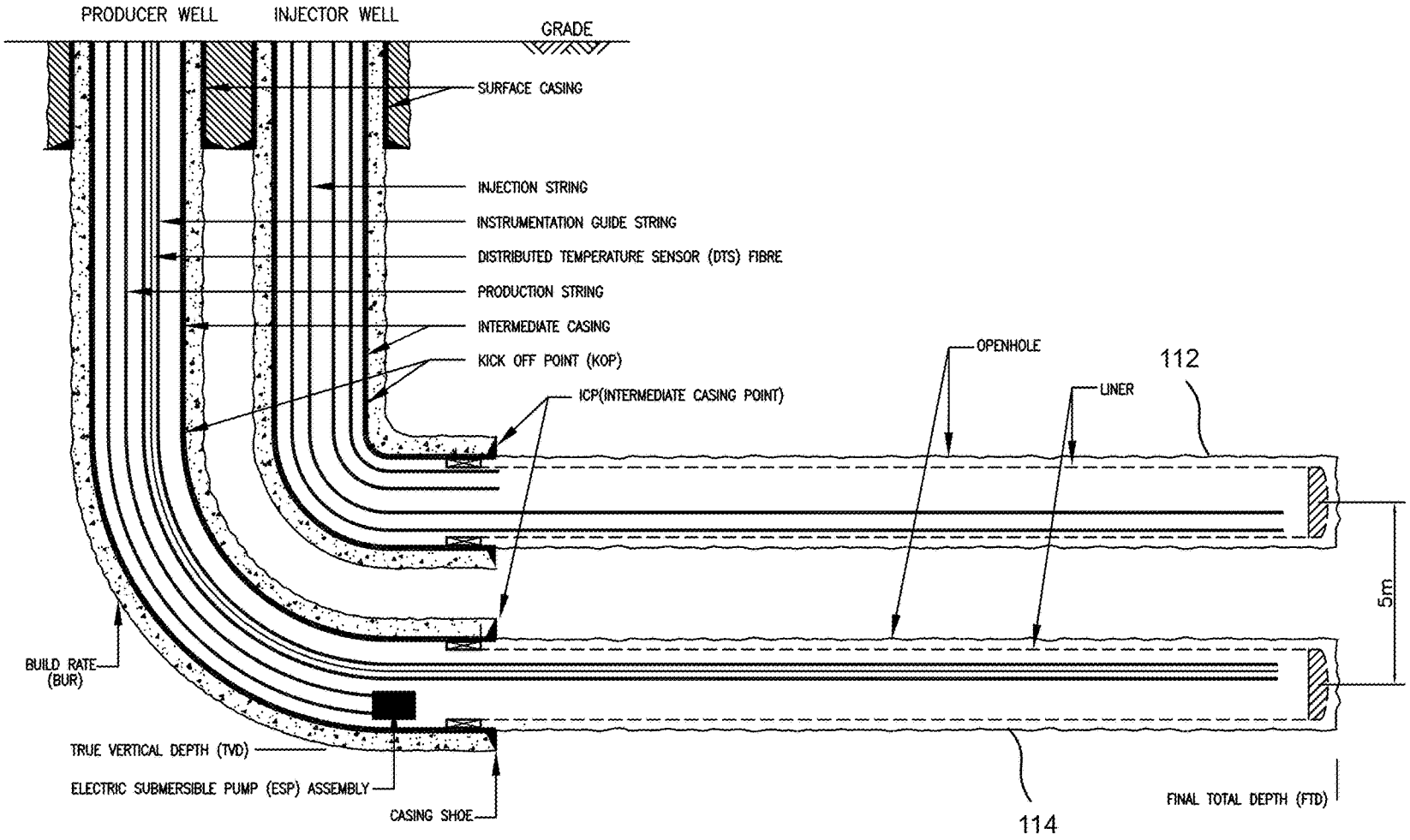
FIG. 18 shows the downhole vertical position relationship of an injection well and the corresponding production well of a well pad of the pad system of FIG. 2.
Figure 19B:
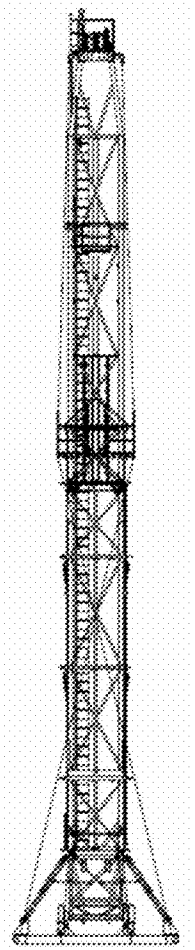
FIGS. 19A and 19B show a rig suitable for servicing the wells of the pad system of FIG. 2.
Figure 19A:
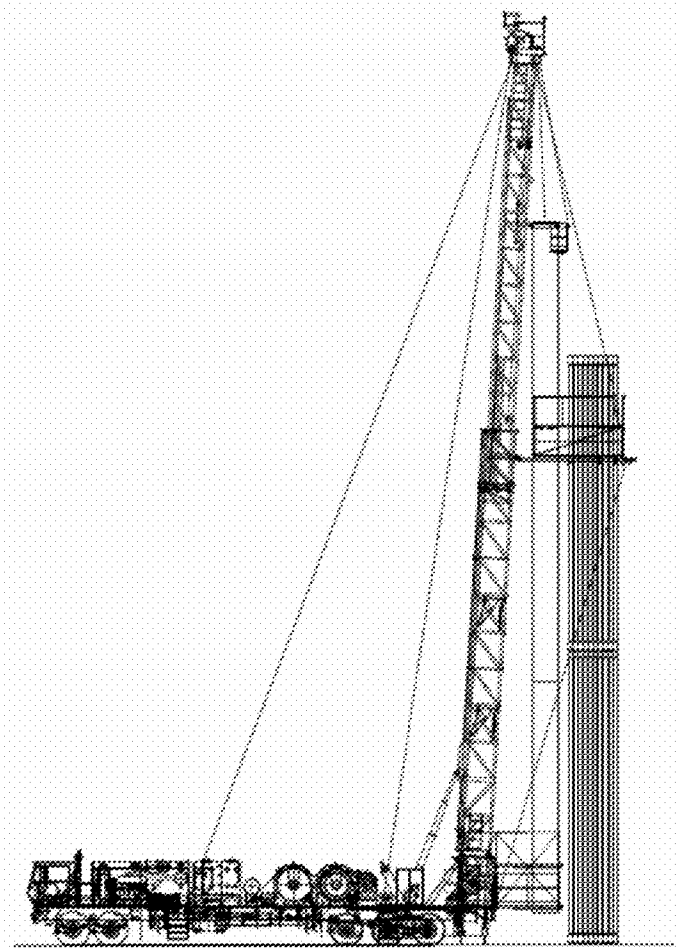

As shown in FIG. 18, the wells may be vertical wells, horizontal wells (with a vertical portion to the surface) or slant wells. In this embodiment, the wells are horizontal wells, with the injection well 112 of each well pair being above the production well 114 thereof. FIGS. 19A and 19B show a rig footprint that may be used for servicing the wells in a well pad and walked laterally from side to side to access each closely-coupled well.

Figure 20A:
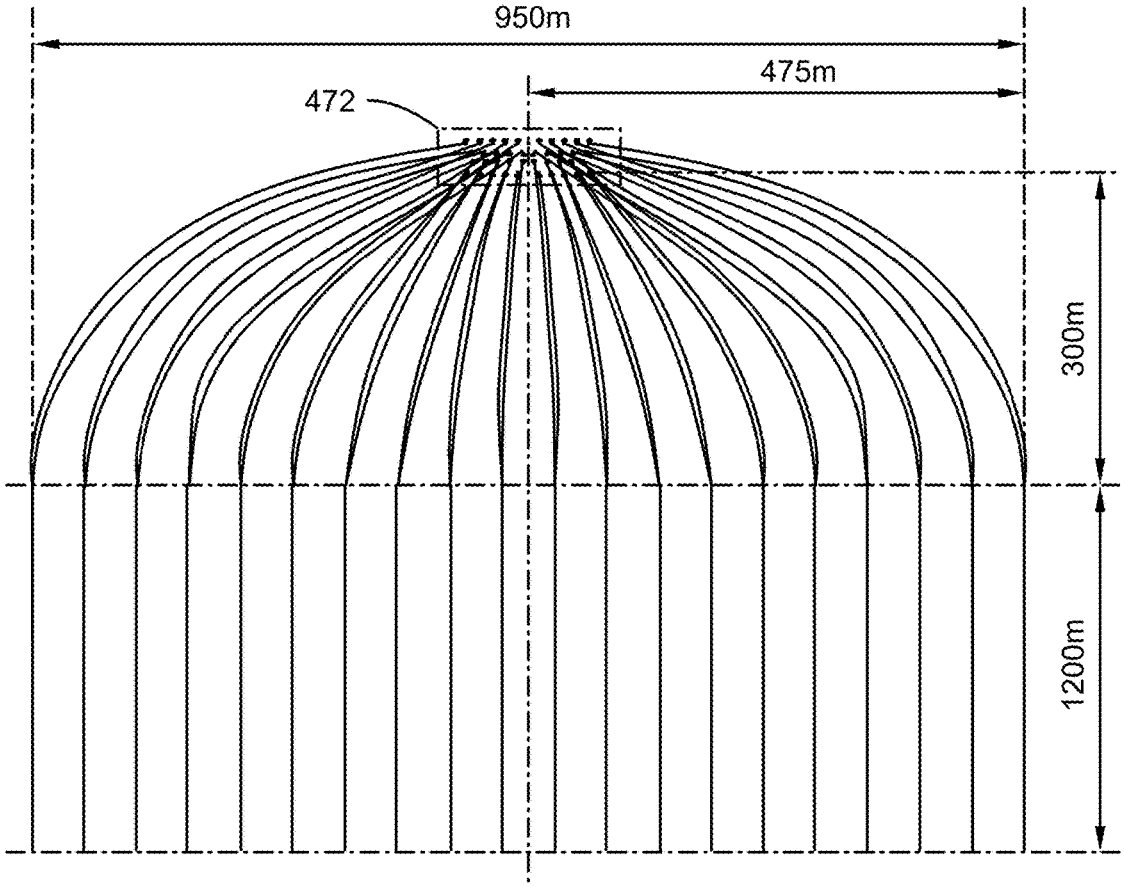
FIGS. 20A and 20B shows the downhole horizontal position relationship of the wells of the multi-well pad of FIG. 3A, using a 20 well pair configuration.
Figure 20B:
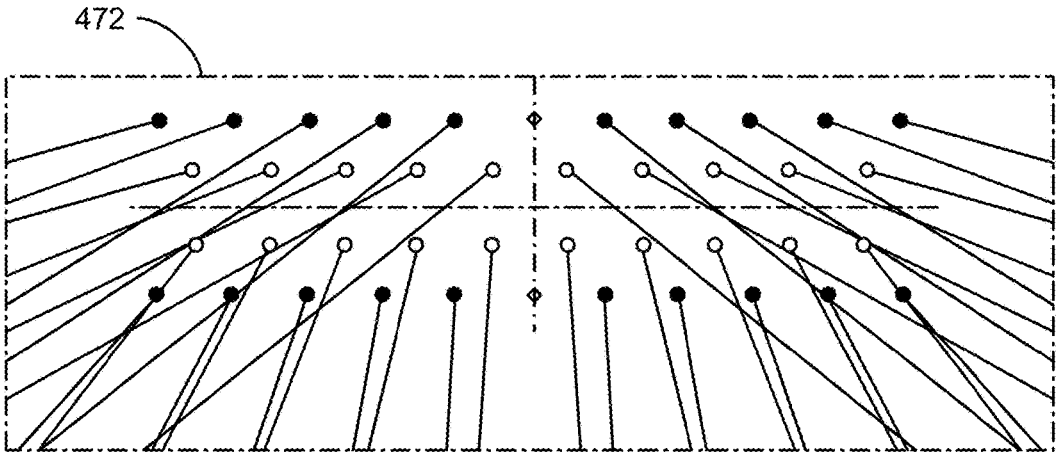
Figure 20C:
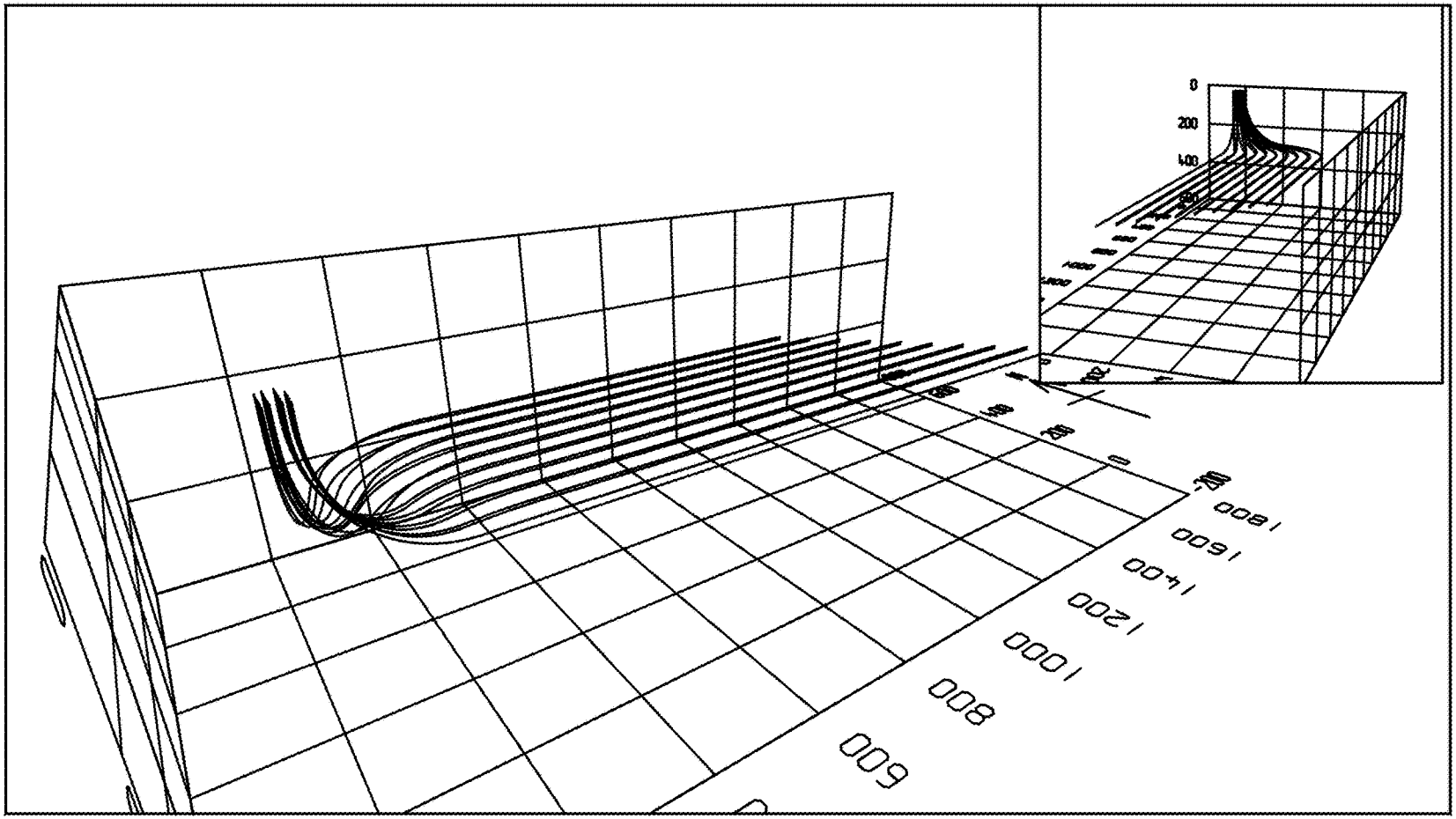
FIG. 20C is a 3D illustration showing the downhole spatial relationship of the wells of the well pad system of FIG. 3A, using a 20 well pair configuration, wherein only 10 well pairs are shown for ease of illustration.

FIGS. 20A to 20C illustrate an example of downhole well deployment for a well pad having 20 well pairs arranged in two well pair rows as described above, with a 12×12×12×6 well pad structure. FIG. 20B shows the detail of the area 472 of FIG. 20A. In this example, each well is vertically drilled to a depth of 250 m, and transits to a 1200 m horizontal well. All wellbores are generally extended towards the same direction after the starting 300 m portion (denoted as uni-direction drilled). The wellbores are carefully arranged to avoid collision. The total span of the subsurface wellbores is generally determined by the number of well pairs in the well pad and the subsurface well spacing. In this example, the subsurface horizontal well spacing is about 50 m. Thus, the wellbores have a span of 475 m on each side with respect to a North-South center axis, giving rise to a total span of 950 m.

In some embodiments, cross-drilling may also be used such that the two rows of well pairs are drilled generally towards opposite directions.

In some embodiments, slant drilling may be used. For example, in one embodiment, a well pad has 20 well pairs arranged in two well pair rows with a 18×18×18×4 structure and cross-drilling. In this example, each well is slant-drilled (with 30° from vertical and 30° lateral) to a depth of 150 m, and transits to an 800 m horizontal well, with a subsurface well spacing of 75 m.

Decreasing the wellhead spacing as well as the downhole spacing will at some point create problems for directional drilling telemetry equipment. Anti-collision assessment tools are used to determine the needs for advanced Wellbore Survey Management techniques, a tighter quality control of survey reading and interpretations. Anti-collision software can be used for determining proximity of planned and/or existing wells using planned and actual well survey data. Sometimes, worst case scenario may be built and simulated using Anti-collision software for evaluating well spacing, well paths and trajectory. The drilling rigs used for installing liners in a shallow SAGD are often the design limitation for the lateral extension (or horizontal well length).

Figure 21A:
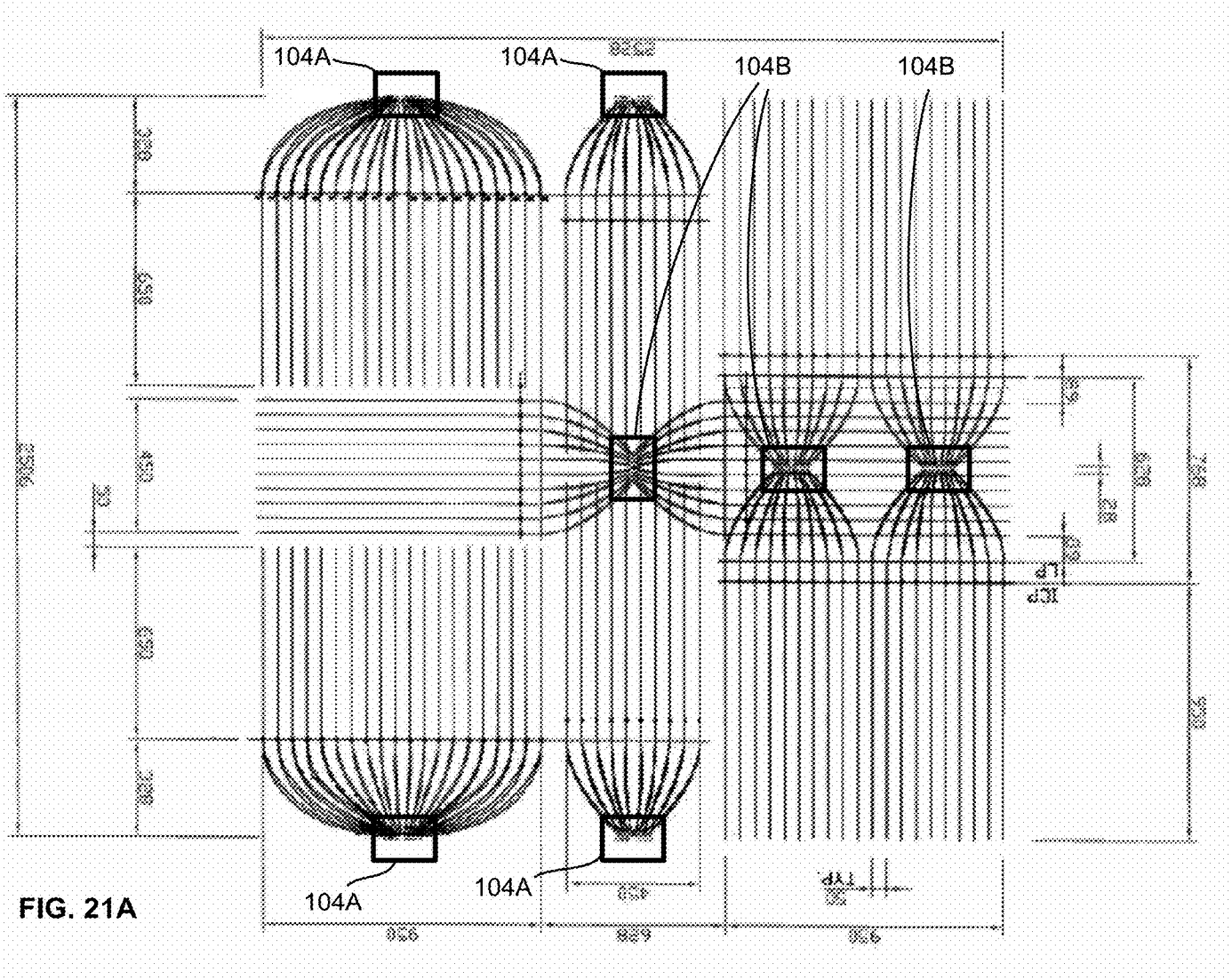
FIGS. 21A to 21C are schematic diagrams of an oil field having a plurality of well pads, according to one embodiment.

FIG. 21A shows an oil field having seven (7) well pads 104A and 104B. Each of the well pads 104A and 104B has 20 well pairs with a 12×12×8×6 well pad structure. As shown, well pads 104A are uni-direction drilled, and well pads 104B are cross-drilled.

Figure 21B:
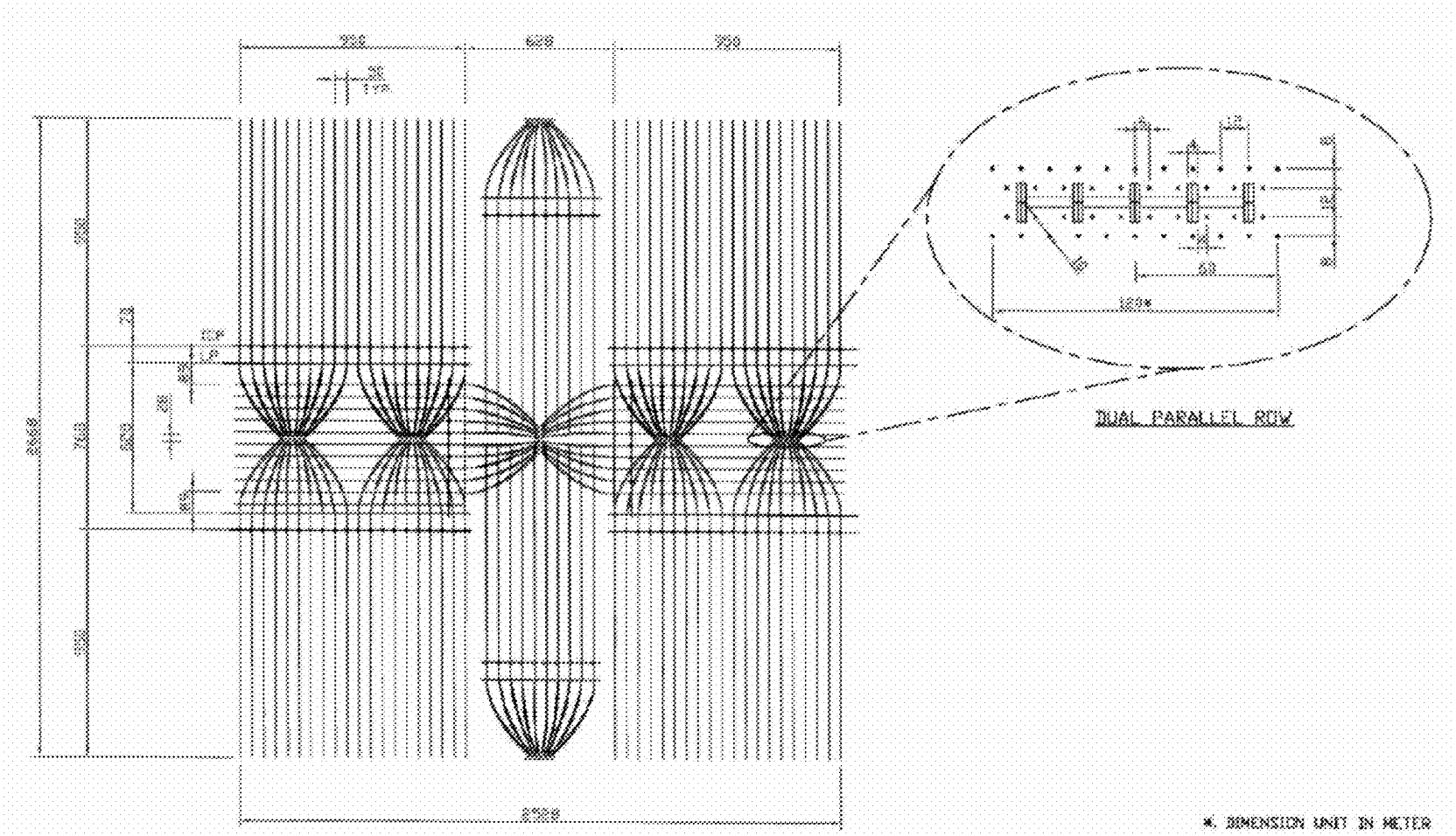

FIG. 21B shows another oil field having seven (7) well pads with each of the well pads having 20 well pairs with a 12×12×8×6 well pad structure. As shown, some well pads are uni-direction drilled, and other well pads are cross-drilled.

Figure 21C:
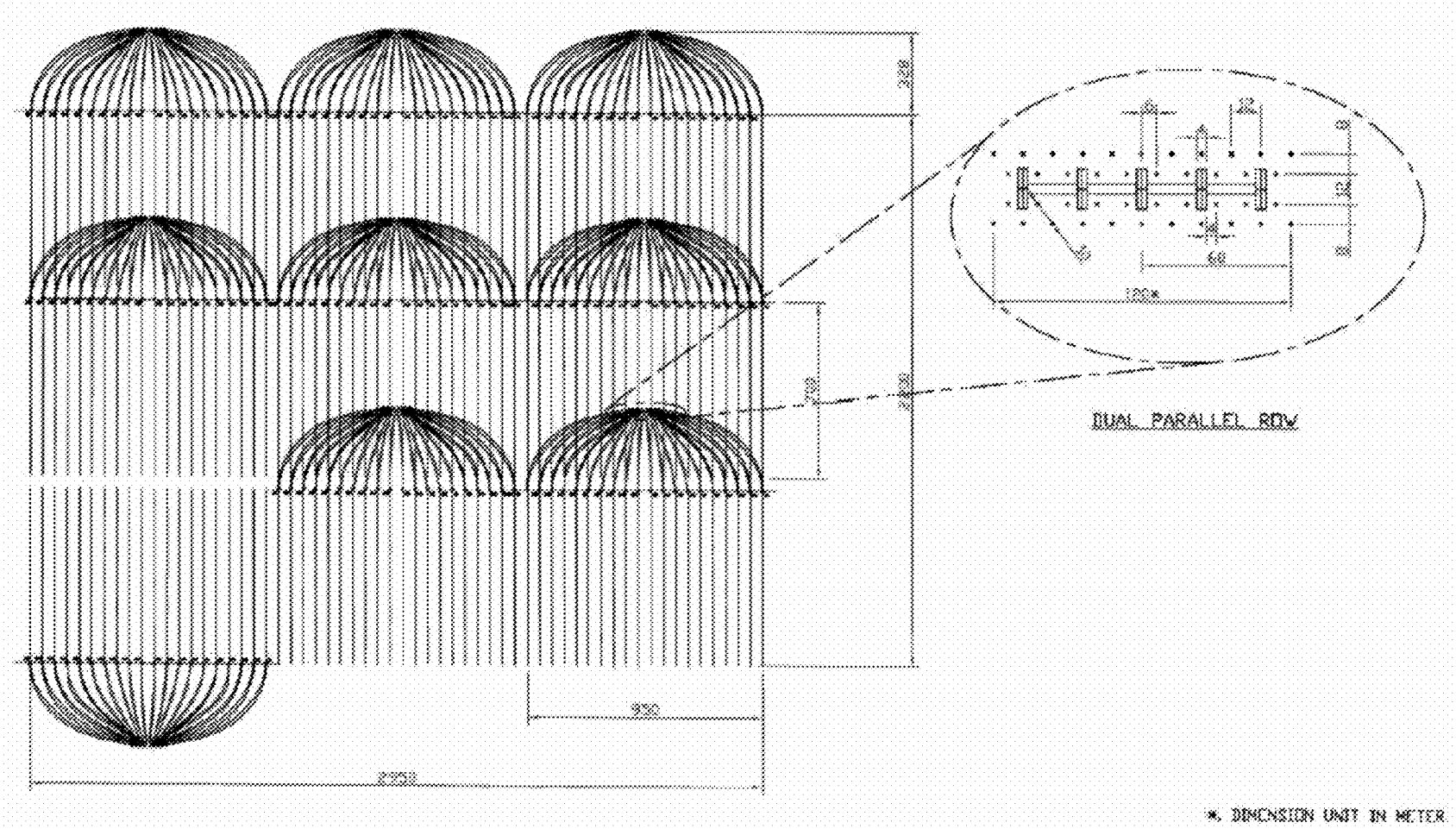

FIG. 21C shows another oil field having seven (7) well pads with each of the well pads having 20 well pairs with a 12×12×8×6 well pad structure. As shown, some well pads are uni-direction drilled, and other well pads are cross-drilled.

FIG. 22 shows an example of well parameters in a well pad.

Well Pad Having Infill Wells

Figure 23A:
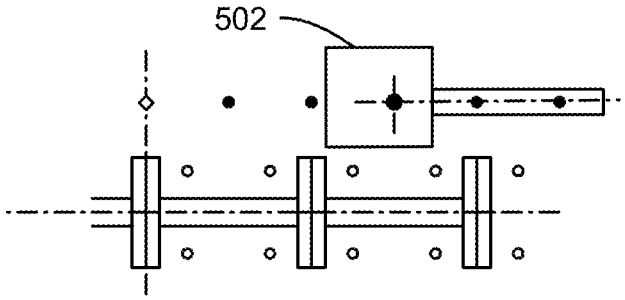
FIGS. 23A to 23C illustrate the drilling process for drilling the infill wells of the multi-well pad of FIG. 3A, according to one embodiment.
Figure 23B:
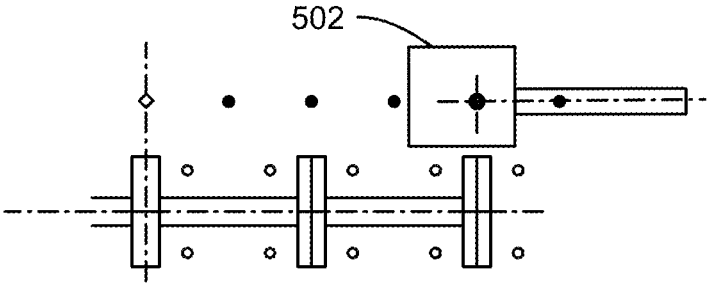
Figure 23C:
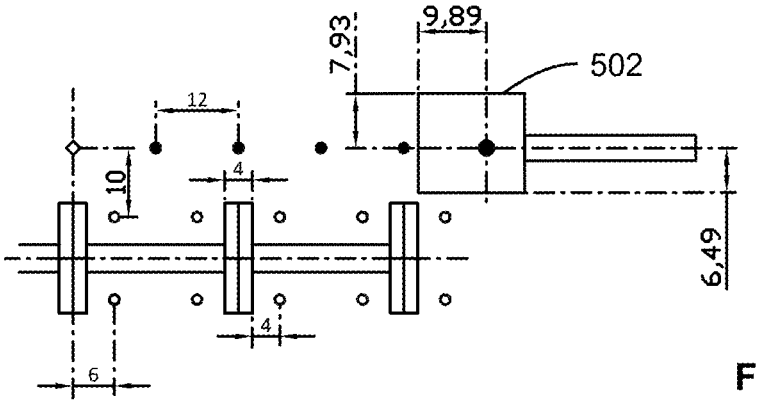
Figure 24A:
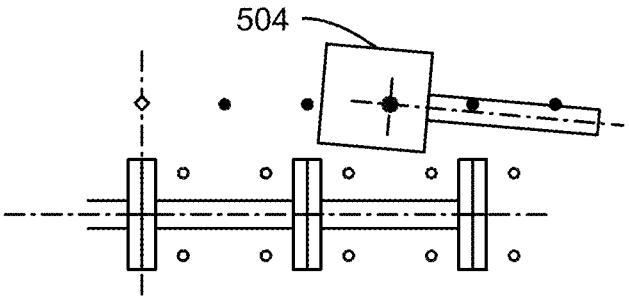
FIGS. 24A to 24C illustrate the drilling process for drilling the infill wells of the multi-well pad of FIG. 3A, according to an alternative embodiment.
Figure 24B:
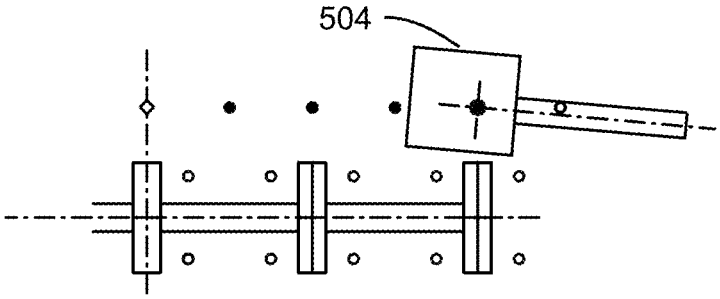
Figure 24C:
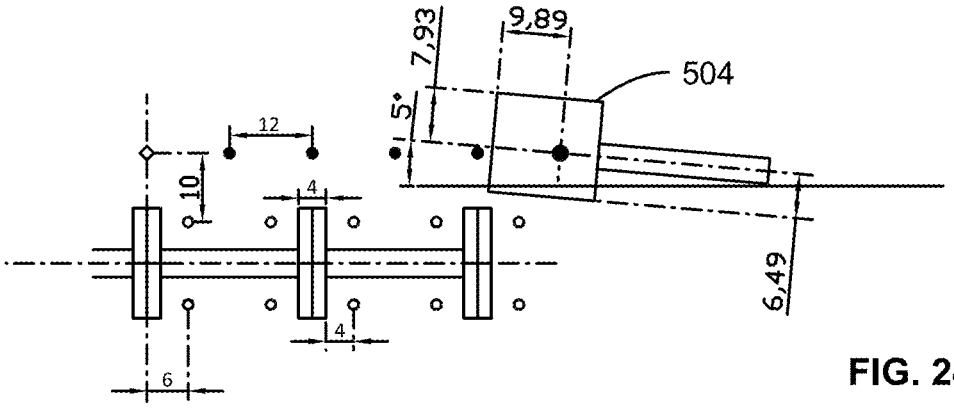

In some alternative embodiments, infill wells may be drilled in existing well pad to increase the number of wells. FIGS. 23A to 23C illustrate drilling infill wells with 10 m spacing in an existing well pad, according to one alternative embodiment. The rig 502 is arranged in parallel to the row of existing wells. FIGS. 24A to 24C illustrate drilling infill wells with 10 m spacing in an existing well pad, according to one alternative embodiment. The rig 504 is arranged at a 5° angle to the row of existing wells.

In some alternative embodiments, the production wells 114 may be used as infill wells. In these embodiments, the two inner rows of wells (corresponding to the injection rows in previous embodiments) are drilled. One inner row of wells are used as injection wells and the other inner row of wells are used as production wells. At a later time, infill wells are drilled at the locations of the two outer rows (corresponding to the production rows in previous embodiments).

Figure 25:
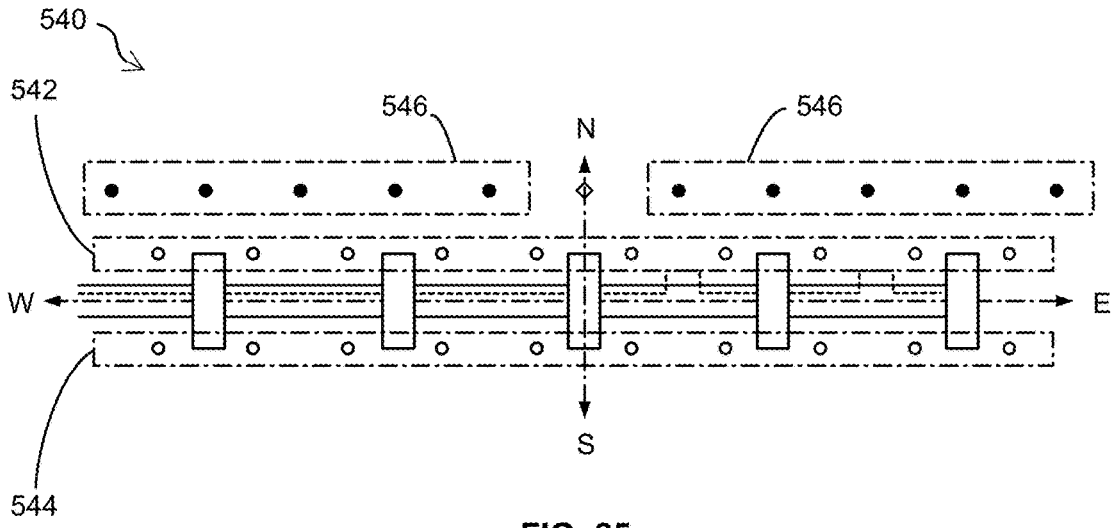
FIGS. 25 and 26 are schematic diagrams of a well pad of the pad system of FIG. 2, according to various embodiments, wherein the well pad has infill wells.

For example, FIG. 25 shows a well pad 540, according to an alternative embodiment. The well pad 540 has a row of injection wells 542 on the NORTH side of the W-E axis, and a row of production wells 544 on the SOUTH side of the W-E axis. The locations of the injection and production wells correspond to those of the injection wellheads in previous embodiments.

A row of infill wells 546 may be drilled at the outer row locations corresponding to the production wellheads in previous embodiments. The row of infill wells 546 are spaced from the row of injection wells 542, farther to the W-E axis than the row of injection wells 542. Each infill well 546 is positioned in the row thereof with an equal distance to its neighboring injection wells 542, or alternatively, with unequal distances to its neighboring injection wells 542 similar as described above.

Figure 26:
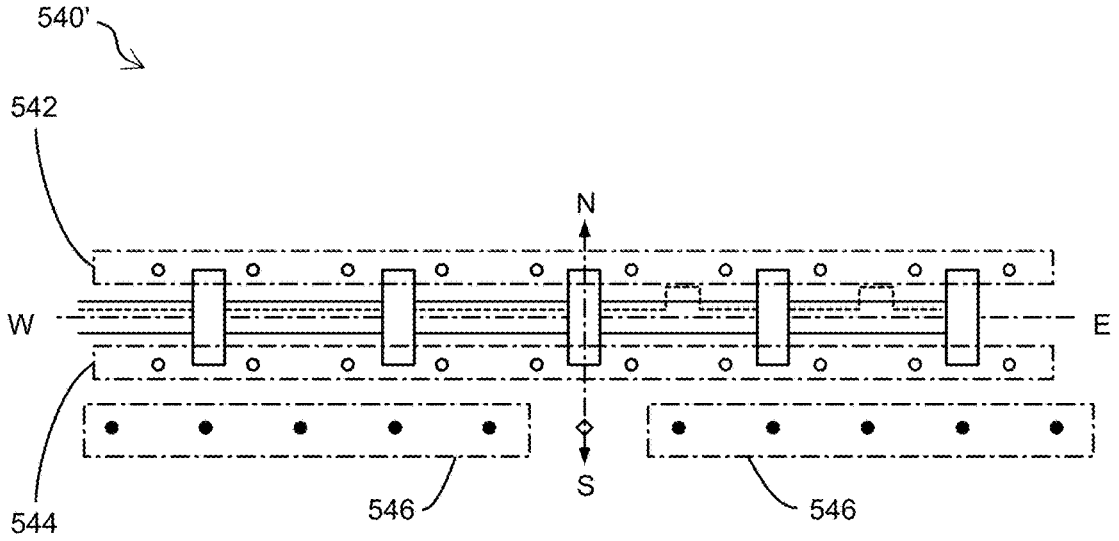

FIG. 26 shows a well pad 540' having a row of infill wells 546, according to another alternative embodiment. The well pattern of FIG. 26 is similar to that of FIG. 25 with the difference that the infill wells 546 are drilled on the SOUTH side, spaced from the row of production wells 544 and farther to the W-E axis than the row of production wells 544.

Figure 27A:
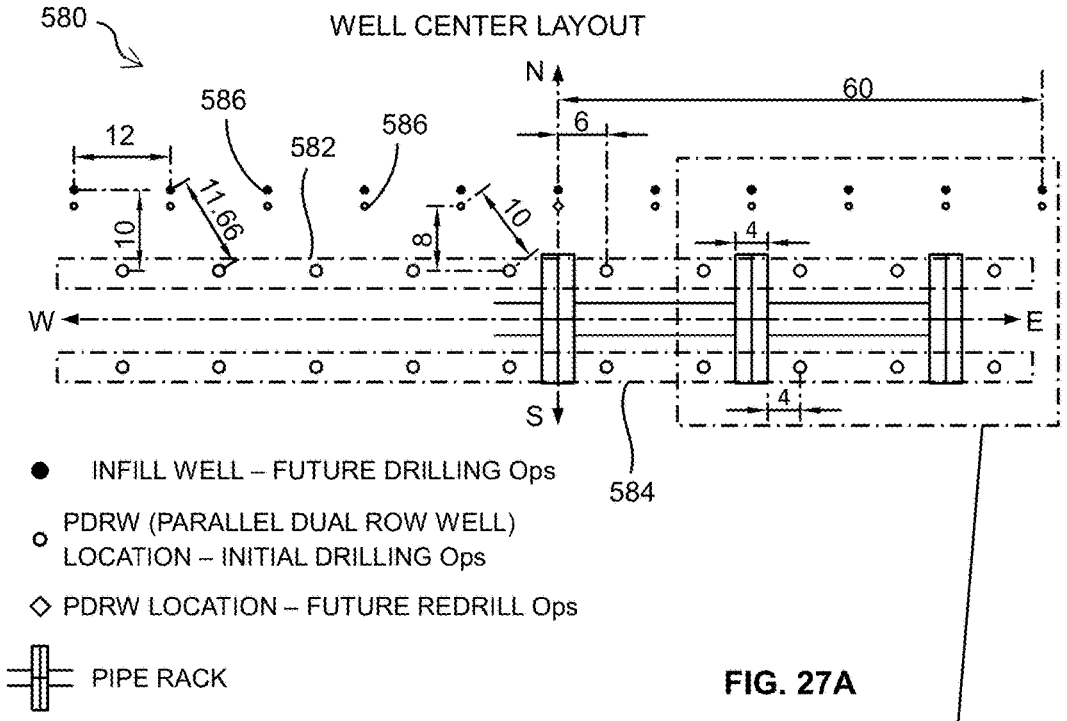
FIGS. 27A and 27B are schematic diagrams of a well pad of the pad system of FIG. 2, according to one embodiment, wherein the well pad has infill wells.
Figure 27B:
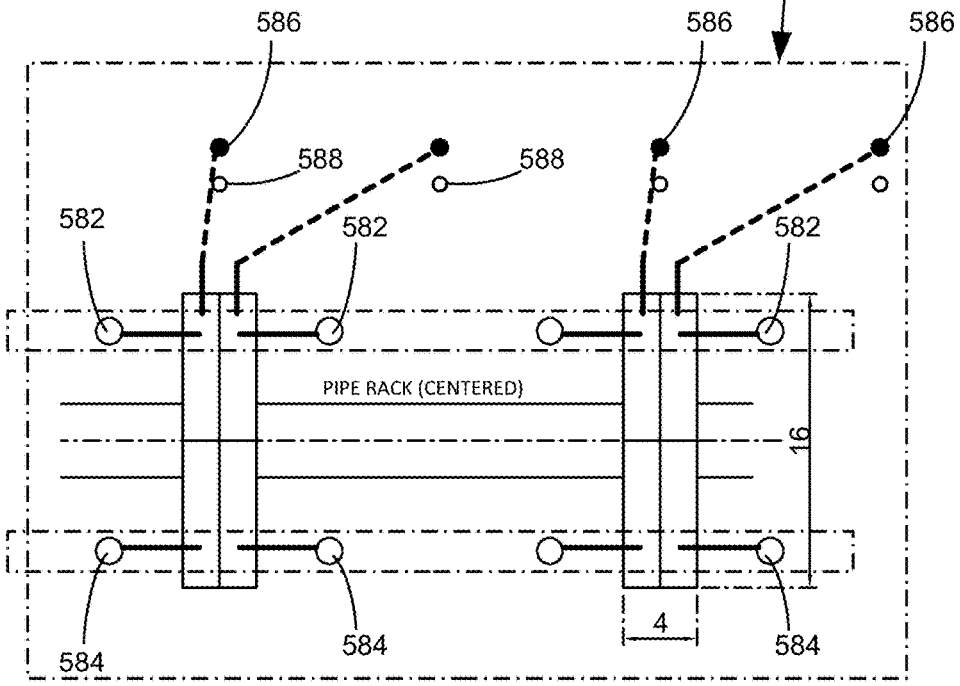

FIGS. 27A and 27B show an example of a well pad 580 having a row of injection wells 582 and a row of production wells 584 deployed at the locations corresponding to those of the injection wellheads in a 12×12×8×6 well pad of previous embodiments. A row of infill wells 586 may be drilled on the NORTH side of the W-E axis. However, in this embodiment, the location of each infill well 586 is about two meters outer from that of the corresponding outer well 588 (i.e., the production well in previous embodiments) such that the row of infill wells 586 is spaced from the row of injection wells 582 by about 10 m, and each infill well 586 is about 11.66 m from either of its two neighboring injection wells 582.

Well Servicing Access

The well servicing access of the well pad system in above embodiments is described as follows. Well piping may be removed for well servicing access.

Figure 28A:
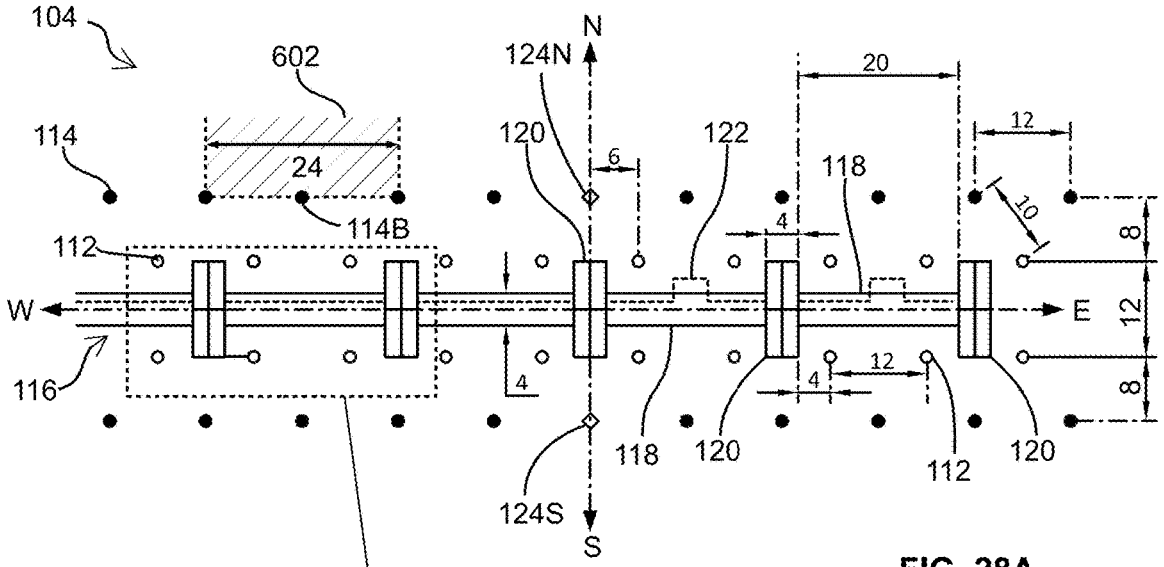
FIGS. 28A and 28B show well service access designs and parameters for a well pad of the pad system of FIG. 2, according to one embodiment.
Figure 28B:
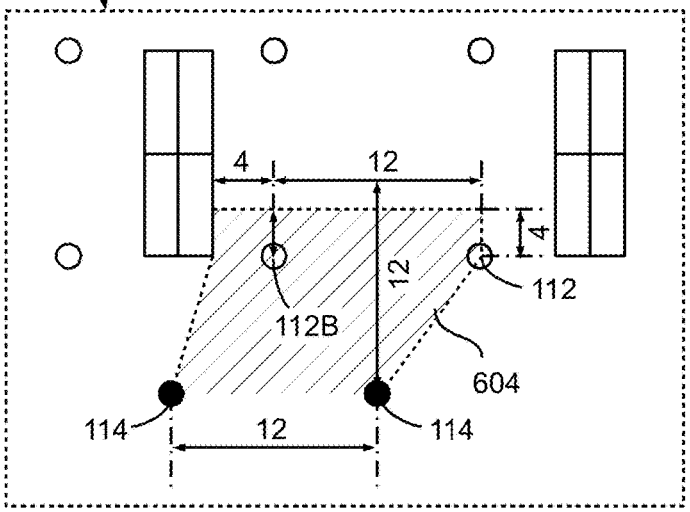

FIGS. 28A and 28B show the well servicing access for a 12×12×8×6 well pad 104 with wellhead connection module 120 having a 4 m width. Each production well, e.g., production well 114B, may be accessed with a 12 m clearance (e.g., the shaded area 602) on each side as the distance between each adjacent pair of production wells is 12 m.

The well servicing access for each injection well, e.g., the injection well 112, is shown as the shaded area 604 with a 12 m entrance clearance.

Similarly, for a well pad with X=16 m (which, as described before, shall read X1=X2=16 m) and Y=16 m, each production well may be accessed with a 16 m clearance, and the well servicing access for each injection well has an area similar to the shaded area 604 of FIG. 28B with a 16 m entrance clearance.

Although embodiments have been described above with reference to the accompanying drawings, those of skill in the art will appreciate that variations and modifications may be made without departing from the scope thereof as defined by the appended claims.

What is claimed is:

1. A well pad system having a first axis and a second axis orthogonal to the first axis, the first and second axes defining a coordinate system having four quadrants and an origin at the intersection of the first and second axes, the system comprising:

a plurality of interconnected first wellhead connection modules arranged in a linear array along the first axis; and in each of N of the four quadrants, N being an integer between 1 and 4, inclusive, a plurality of first wellheads forming a first row of wellheads parallel to the first axis and spaced therefrom with a distance of a positive number Y/2; and a plurality of second wellheads forming a second row of wellheads parallel to the first axis and spaced therefrom with a distance of a positive number Y/2+Z; wherein the plurality of first and second wellheads are connected to the plurality of first well connection modules; and wherein the first wellheads are offset laterally from the second wellheads such that each neighboring pair of first wellheads has a second wellhead therebetween, forming an acute-angled triangle, wherein each first wellhead connection module has a neighboring first wellhead located laterally on each side of the left-hand and right-hand sides thereof and connected thereto, and each two adjacent first wellhead connection modules have two first wellheads therebetween;

a second wellhead connection module centered at the origin, the second wellhead connection module aligning to the plurality of first wellhead connection modules and interconnected therewith;

two of third wellheads on a first side of the first axis forming a third row of wellheads parallel to the first axis and spaced therefrom, the two of third wellheads respectively on the first side of the second axis and an opposite second side of the second axis and connected to the second wellhead connection module; and two of fourth wellheads on the first side of the first axis forming a fourth row of wellheads parallel to the first axis and spaced therefrom, the distance between the fourth row of wellheads and the first axis being greater than that between the third row of wellheads and the first axis, the two of fourth wellheads respectively on the first and second sides of the second axis and connected to the second wellhead connection module.

2. The well pad system of claim 1 further comprising:

two of fifth wellheads on a second side of the first axis opposite to the first side, the two of fifth wellheads forming a fifth row of wellheads parallel to the first axis and spaced therefrom, the two of fifth wellheads respectively on the first and second sides of the second axis and connected to the second wellhead connection module; and two of sixth wellheads on the first side of the first axis forming a sixth row of wellheads parallel to the first axis and spaced therefrom, the distance between the sixth row of wellheads and the first axis being greater than that between the fifth row of wellheads and the first axis, the two of sixth wellheads respectively on the first and second sides of the second axis and connected to the second wellhead connection module.

3. The well pad system of claim 2 wherein in each of the N quadrants, each first wellhead is paired with an immediate neighboring second wellhead forming a well pair, the well pair forming a well pair vector from the first wellhead thereof to the second wellhead thereof, the projection of the well pair vector onto the first axis pointing away from the origin and the projection of the well pair vector onto the second axis also pointing away from the origin.

4. The well pad system of claim 1 wherein N is greater than 1; and wherein the Y/2 in a first one of the N quadrants is the same as the Y/2 in a second one of the N quadrants.

5. The well pad system of claim 4 wherein Y is a value between about 6 m and about 30 m, inclusive.

6. The well pad system of claim 4 wherein Y is a value between about 6 m and about 30 m, inclusive.

7. The well pad system of claim 1 wherein N is greater than 1; and wherein the distance between the first and second rows of wellheads is Z, and wherein the Z in a first one of the N quadrants is the same as the Z in a second one of the N quadrants.

8. The well pad system of claim 1 to wherein in each of the N quadrants, each pair of adjacent first wellheads connected to the same wellhead connection module are spaced by a first distance X1, and each pair of adjacent first wellheads connected to different wellhead connection modules are spaced by a second distance X2.

9. The well pad system of claim 8 wherein X1 is equal to X2.

10. The well pad system of claim 8 wherein X2 is smaller than X1.

11. The well pad system of claim 8 wherein either of X1 and X2 is a value between about 6 m and about 30 m, inclusive.

12. The well pad system of claim 8 wherein X1 is different than X2.

13. The well pad system of claim 8 wherein either of X1 and X2 is a value between about 6 m and about 30 m, inclusive.

14. The well pad system of claim 1 wherein N is greater than 1, and wherein, in each of the N quadrants, the distance along the first axis between each first wellhead and the neighboring second wellhead on the second-axis side thereof is D, and wherein D is a same value for all N quadrants.

15. The well pad system of claim 14 wherein D is a value between about 1 m and about 20 m, inclusive.

16. The well pad system of claim 14 wherein D is a value between about 1 m and about 15 m, inclusive.

17. The well pad system of claim 1 to wherein the well pad system is a Steam Assisted Gravity Drainage (SAGD) well pad system.

18. The well pad system of claim 1 wherein for each well pair in each of the N quadrants, the first wellhead thereof is an injection wellhead, and the second wellhead thereof is a production wellhead.

19. The well pad system of claim 1 wherein N is greater than 1; and wherein the Y/2 in a first one of the N quadrants is different than the Y/2 in a second one of the N quadrants.

20. The well pad system of claim 19 wherein Y is a value between about 6 m and about 30 m, inclusive.

* * * * *